US012742445B2

(12) United States Patent
Stiles

(10) Patent No.: US 12,742,445 B2
(45) Date of Patent: Sep. 22, 2026

(54) GREENHOUSE GAS REDUCTION WITH EXTERNALLY PRESSURIZED GAS SEAL AND GAS LUBRICATION FOR A RECIPROCATING COMPRESSOR

(71) Applicant: Axip Energy Services, LP, Dallas, TX (US)

(72) Inventor: David Thomas Stiles, Austin, TX (US)

( * ) Notice: Subject to any disclaimer, the term of this patent is extended or adjusted under 35 U.S.C. 154(b) by 0 days.

(21) Appl. No.: 19/001,742

(22) Filed: Dec. 26, 2024

(65) Prior Publication Data

US 2025/0122869 A1 Apr. 17, 2025

Related U.S. Application Data

(63) Continuation of application No. 18/427,358, filed on Jan. 30, 2024, now Pat. No. 12,209,580.

(60) Provisional application No. 63/482,205, filed on Jan. 30, 2023.

(51) Int. Cl.
*F04B 39/00* (2006.01)
*F04B 39/12* (2006.01)

(52) U.S. Cl.
CPC ..... *F04B 39/0022* (2013.01); *F04B 39/0094* (2013.01); *F04B 39/121* (2013.01)

(58) Field of Classification Search
CPC ..... F04B 39/0022; F04B 39/0215; F04B 39/0276; F04B 39/0094; F04B 39/041; F04B 39/121
See application file for complete search history.

(56) References Cited

U.S. PATENT DOCUMENTS

| | | | | |
|---|---|---|---|---|
| 2,878,990 | A * | 3/1959 | Zurcher | F04B 39/0292 92/87 |
| 3,490,774 | A * | 1/1970 | Henry | F16J 15/441 277/543 |
| 5,199,345 | A * | 4/1993 | Meier | F04B 39/041 277/902 |
| 6,016,738 | A * | 1/2000 | Elferink | F16J 1/02 92/158 |
| 6,378,875 | B1 | 4/2002 | Feistel | |
| 9,880,065 | B1 * | 1/2018 | Miguez | F04B 39/041 |
| 10,215,229 | B2 * | 2/2019 | Svrcek | F16J 1/06 |
| 10,247,183 | B2 * | 4/2019 | Koop | F04B 53/12 |

(Continued)

FOREIGN PATENT DOCUMENTS

| | | |
|---|---|---|
| CN | 104806473 A | 7/2015 |
| CN | 107842481 A | 3/2018 |

OTHER PUBLICATIONS

International Searching Authority, "Search Report and Written Opinion," issued in connection with PCT patent application No. PCT/US2024/013580, mailed on Apr. 19, 2024, 10 pages.

*Primary Examiner* — Thomas E Lazo
(74) *Attorney, Agent, or Firm* — Keith C. Rawlins, Esq.; Scheef & Stone, L.L.P.

(57) ABSTRACT

Externally pressurized gas is used to provide a gas seal and gas lubrication for a piston rod packing unit of a reciprocating compressor. The externally pressurized gas can also be used to provide gas lubrication for the cylinder via flow of the externally pressurized gas through the piston of the reciprocating compressor. The gas seal and gas lubrication can reduce or eliminate greenhouse gas emissions from a reciprocating compressor used to compress natural gas.

16 Claims, 8 Drawing Sheets

(56) References Cited

U.S. PATENT DOCUMENTS

| | | | | |
|---|---|---|---|---|
| 2013/0058815 | A1* | 3/2013 | Kim | F04B 39/122 417/437 |
| 2013/0167795 | A1* | 7/2013 | Lawler | F16J 1/02 123/193.2 |
| 2016/0245274 | A1* | 8/2016 | Nagura | F04B 39/12 |
| 2020/0347881 | A1 | 11/2020 | Devitt et al. | |
| 2020/0386218 | A1* | 12/2020 | Feistel | F16J 15/26 |
| 2022/0389922 | A1* | 12/2022 | Martin | F16J 15/189 |
| 2024/0254981 | A1 | 8/2024 | Stiles | |

* cited by examiner

GREENHOUSE GAS REDUCTION WITH EXTERNALLY PRESSURIZED GAS SEAL AND GAS LUBRICATION FOR A RECIPROCATING COMPRESSOR

CROSS-REFERENCE TO RELATED APPLICATIONS

This is a continuation of U.S. Non-Provisional patent application Ser. No. 18/427,358, filed on Jan. 30, 2024, entitled "Greenhouse Gas Reduction with Externally Pressurized Gas Seal and Gas Lubrication for a Reciprocating Compressor," which claims the benefit of and priority to U.S. Provisional Patent Application No. 63/482,205, filed on Jan. 30, 2023, entitled "Externally Pressurized Secondary Gas Rod Packing for a Reciprocating Compressor, Externally Pressurized Secondary Gas Cylinder Lubrication for a Reciprocating Compressor," each of which is incorporated by reference herein in its entirety.

FIELD OF THE DISCLOSURE

The present disclosure generally relates to reciprocating compressors, and more particularly to seals and lubrication of moving parts of reciprocating compressors.

BACKGROUND

Reciprocating compressors compress a gas from a first, lower pressure to a second, higher pressure. To accomplish the compression a piston is reciprocated longitudinally in a cylinder between two positions. The supplied gas is compressed to a smaller volume by the piston, and the gas at the second, higher pressure is discharged from the cylinder. The piston has a piston head connected to a piston rod; the entire piston being contained in a housing of the reciprocating compressor. The cylinder interior is fluidly separated from the rest of the equipment of the reciprocating compressor (e.g., the crank shaft, connecting rod, and crosshead) by a packing unit, which functions to seal around the piston rod to prevent the flow of the gas being worked in the cylinder by the piston into the interior of the housing of the reciprocating compressor.

The packing unit generally has one or more packing rings that fit around the piston rod to create a seal between the moving piston rod and the stationary packing unit. The seal reduces the amount of the worked gas in the cylinder from moving into the hollow interior of the reciprocating compressor that houses the rest of the equipment; however, it is generally found that small amounts of worked gas (e.g., natural gas being compressed) can be lost through the packing unit. The worked gas generally leaks from the packing unit into the housing in small amounts. In some cases, newly installed packing rings and piston rods can leak up to 60 cubic feet of methane per hour, per cylinder in a natural gas reciprocating compressor. Over time, the packing rings can become worn, and the worked gas can leak in larger and larger amounts. For example, worn packing rings and piston rods can leak up to 900 cubic feet of methane per hour, per cylinder in a natural gas reciprocating compressor.

In one solution to prevent or reduce methane leakage from the packing unit, the packing rings are lubricated with an oil to help extend the useful life of the packing rings, enhance the seal against the piston rod, and remove heat (for a circulated oil). However, the lubricating oil also leaks from the packing unit and can be lost to an extent that lubricating oil must be supplied to the packing unit on a regular basis.

The cylinder of the reciprocating compressor can also be lubricated with a lubricating oil for movement of the piston head therein. The lubricating oil within the cylinder can also be lost into the compressed gas.

Lubricating oil is consumed or lost by a reciprocating compressor in an amount that can be, for example, 5 gallons (18.9 liters) per day, per reciprocating compressor. Moreover, leakage of the worked gas from the packing unit, when the worked gas is natural gas can result in greenhouse gas emissions from a reciprocating compressor.

There is a need to reduce the amount of process gas, especially process gas that contains greenhouse gases, lost and lubricating oil consumed by a reciprocating compressor, and to reduce the amount of greenhouse gases emitted by reciprocating compressors.

SUMMARY

Disclosed are processes, reciprocating compressors, piston rod packing units, and pistons that can reduce or eliminate the amount of gases, including greenhouse gases, emitted into the atmosphere, directly through preventing leakage of such gases from the reciprocating compressor and indirectly through reducing the amount of lubricating oil consumed by the reciprocating compressor.

One of the processes includes: receiving, by a reciprocating compressor, a process gas having a process pressure; compressing, by the reciprocating compressor, the process gas to form a compressed gas having a compression pressure, wherein the compression pressure is greater than the process pressure; and injecting a secondary gas into a first ring of a plurality of packing rings of a piston rod packing unit of the reciprocating compressor at a first injection pressure that is greater than the compression pressure, wherein each of the plurality of packing rings is configured to surround an outer wall of a piston rod of the reciprocating compressor, wherein the first ring of the plurality of packing rings has a permeable flowpath, a channel, or both a permeable flowpath and a channel formed therein, wherein the secondary gas passes through the permeable flowpath, the channel, or both the permeable flowpath and the channel of the first ring, to form a first gas interface between the outer wall of the piston rod and the first ring of the plurality of packing rings.

The reciprocating compressor can include: a prime mover; a crank shaft coupled to the prime mover, wherein the prime mover is configured to turn the crank shaft; a connecting rod having an end coupled to the crank shaft; a crosshead coupled to an opposite end of the connecting rod; a piston including a piston assembly and a piston rod, the piston rod having an end coupled to the crosshead; a cylinder having an interior configured for a longitudinal movement of the piston assembly therein; a process gas inlet fluidly connected to the interior of the cylinder and a compressed gas outlet fluidly connected to the interior of the cylinder; a piston rod packing unit including: a rod packing case having a gas inlet port formed therein; a compression sleeve placed within the rod packing case, wherein an outer wall of the compression sleeve contacts an inner wall of the rod packing case; a plurality of packing rings placed within the compression sleeve, wherein each of the plurality of packing rings is configured to surround an outer wall of a piston rod, wherein each of the plurality of packing rings has a permeable flowpath, a channel, or both a permeable flowpath and a channel formed therein; wherein the gas inlet port fluidly connects with the channel of at least one of the plurality of packing rings. In aspects, the piston rod packing unit is configured to utilize an externally pressurized secondary gas received via the gas inlet port to provide a gas seal between i) one or more of the plurality of packing rings and ii) the piston rod, wherein the gas seal prevents or reduces process gas and compressed gas in the interior of the cylinder from leaking from the piston rod packing unit into a hollow interior of a housing of the reciprocating compressor, while allowing a reciprocating movement of the piston rod in the piston rod packing unit.

The piston rod packing unit for the reciprocating compressor can include: a rod packing case having a gas inlet port formed therein; a compression sleeve placed within the rod packing case, wherein an outer wall of the compression sleeve contacts an inner wall of the rod packing case; and a plurality of packing rings placed within the compression sleeve, wherein each of the plurality of packing rings is configured to surround an outer wall of a piston rod, wherein each of the plurality of packing rings has a channel formed therein; wherein the gas inlet port fluidly connects with the channel of at least one of the plurality of packing rings.

Another process can include: receiving, by a reciprocating compressor, a process gas having a process pressure; compressing, by the reciprocating compressor, the process gas to form a compressed gas having a compression pressure, wherein the compression pressure is greater than the process pressure; and injecting a piston gas through a channel formed in a piston rod and into one or more distribution channels formed in a piston assembly at an injection pressure that is greater than the compression pressure; wherein the piston gas passes through the one or more distribution channels to form a gas interface between an outer surface of the piston assembly and an inner surface of a cylinder of the reciprocating compressor.

Another reciprocating compressor can include: a prime mover; a crank shaft coupled to the prime mover, wherein the prime mover is configured to turn the crank shaft; a connecting rod having an end coupled to the crank shaft; a crosshead coupled to an opposite end of the connecting rod; a piston including a piston assembly and a piston rod, the piston rod having an end coupled to the crosshead; a cylinder having an interior configured for a longitudinal movement of the piston assembly therein; a process gas inlet fluidly connected to the interior of the cylinder and a compressed gas outlet fluidly connected to the interior of the cylinder; and a piston rod packing unit configured to receive a portion of the piston rod therein; wherein the piston rod of the piston has: a gas supply port formed in a first location of the piston rod that is configured to reciprocate within a piston rod packing unit; a gas outlet port formed in a second location of the piston rod; and a channel formed in an interior of the piston rod, wherein the channel is fluidly connected to the gas supply port and the gas outlet port; wherein the piston assembly includes: a piston core including one or more gas distribution channels in fluid communication with the gas outlet port of the piston rod; a plurality of piston segments, wherein each of the plurality of piston segments has a channel in fluid communication at least one of the one or more gas distribution channels of the piston core; and a gas permeable ring placed around the plurality of piston segments, wherein the gas permeable ring is fluidly connected to the channels of the plurality of piston segments.

The piston for the reciprocating compressor can include: a piston rod having: a gas supply port formed in a first location of the piston rod that is configured to reciprocate within a piston rod packing unit; a gas outlet port formed in a second location of the piston rod; and a channel formed in an interior of the piston rod, wherein the channel is fluidly connected to the gas supply port and the gas outlet port; and a piston assembly connected to the piston rod, wherein the piston assembly includes: a piston core including one or more gas distribution channels in fluid communication with the gas outlet port of the piston rod; a plurality of piston segments, wherein each of the plurality of piston segments has a channel in fluid communication at least one of the one or more gas distribution channels of the piston core; and a gas permeable ring placed around the plurality of piston segments, wherein the gas permeable ring is fluidly connected to the channels of the plurality of piston segments.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Figure 1A:
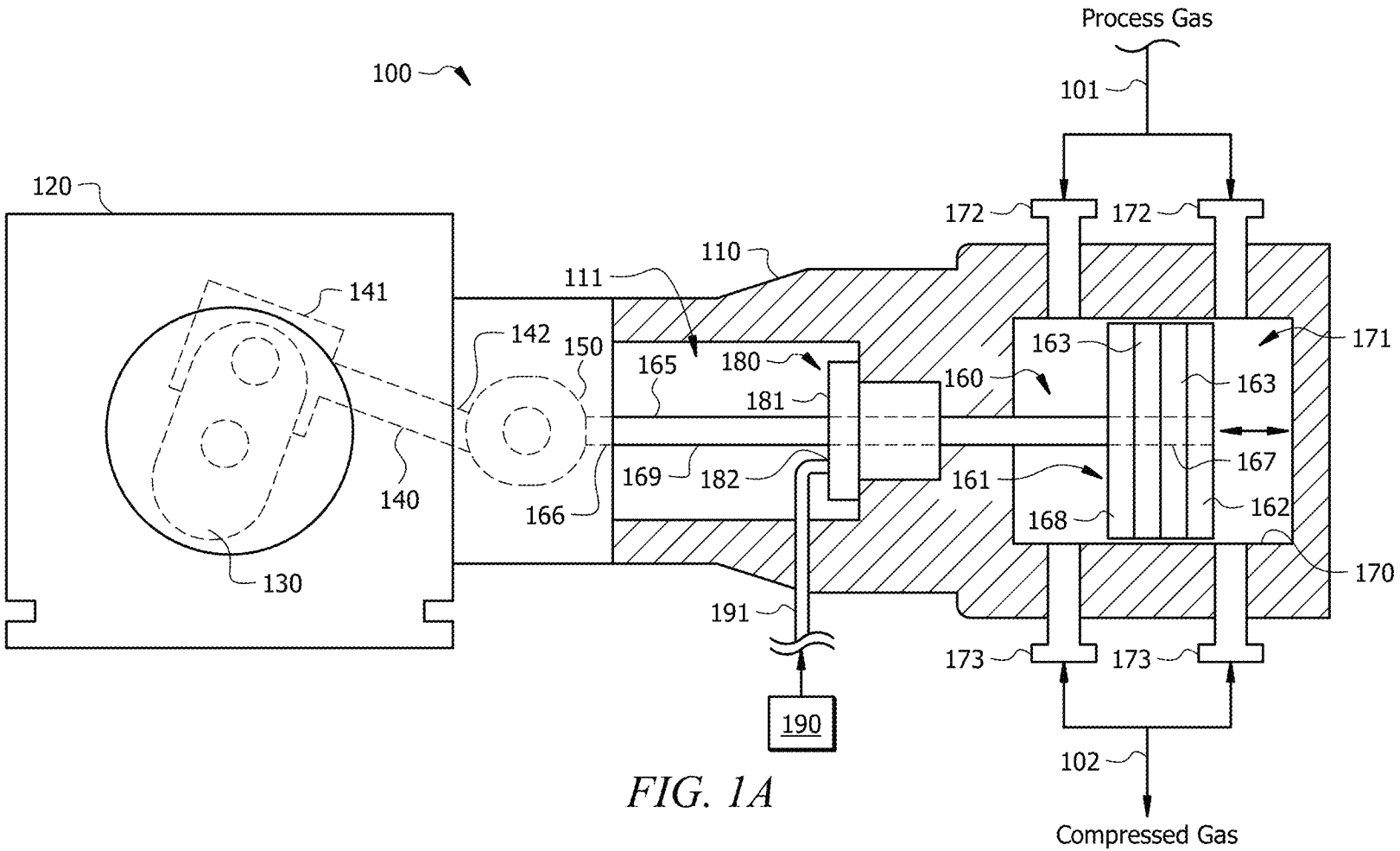
FIG. 1A illustrates a side view of a reciprocating compressor having a secondary gas supplied to the piston rod packing unit for gas seal and gas lubrication of packing rings in the piston rod packing unit.

"Process gas" as used herein means a gas that is received into the reciprocating compressor and compressed by the reciprocating compressor to form the compressed gas. An example of a process gas is natural gas. Other examples of a process gas include air, hydrogen, methane, ethane, propane, butane, or a combination thereof (one combination being, by example, natural gas).

"Secondary gas" as used herein means a gas that is not the process gas being compressed by the reciprocating compressor. In aspects, the secondary gas is not flammable and is inert to the operation of the reciprocating compressor. An example of a secondary gas as used herein includes nitrogen, argon, another inert gas, or a combination thereof. In aspects, the secondary gas does not include, and excludes, any greenhouse gas. In additional or alternative aspects, a secondary gas is not a gas that can combust under operating conditions of the reciprocating compressor. In additional or alternative aspects, the secondary gas is not a gas that facilitates combustion of the process gas or the compressed gas under operating conditions of the reciprocating compressor. The secondary gas can also be referred to as a dry gas, a lubricant gas, a packing gas, a piston gas, or any of these.

"Dry gas" as used herein means that the gas has less than 0.1, 0.09, 0.08, 0.07, 0.06, 0.05, 0.04, 0.03, 0.02, 0.01, 0.001, or 0.0001 vol % of any liquid based on a total volume of the gas.

"Process compatible gas" as used herein means a gas that is compatible with the process gas being compressed. Process compatible gas can have the same composition as the process gas, where the process compatible gas is pressurized to a high pressure (as that is defined herein), or the process compatible gas can be another species of gas such as hydrogen from a hydrogen source, at a high pressure. The process compatible gas can also be referred to as a dry gas, a lubricant gas, a packing gas, a piston gas, or any of these.

"High pressure" as used herein, when referred to as a pressure for the secondary gas or the process compatible gas, means a pressure that is greater than the compression pressure in the cylinder of the reciprocating compressor.

"Externally pressurized" when referring to the secondary gas or the process compatible gas herein means that the pressure source for the gas is not the cylinder of the reciprocating compressor into which the gas is injected. For example, an "externally pressurized" gas is a gas that is provided at a high pressure from a gas source that is external to the cylinder of the reciprocating compressor in which the gas is injected into the piston rod packing unit and/or into the piston of the reciprocating compressor. The gas source that is external to the cylinder of the reciprocating compressor can be a compressed gas from another reciprocating compressor, such as a later-stage compressor that has a discharge compression pressure higher than the compression pressure of the reciprocating compressor into which the gas is injected into the piston rod packing unit and/or the piston of the reciprocating compressor.

Disclosed are externally pressurized gas seal and externally pressurized gas lubrication for a reciprocating compressor. More particularly, an externally pressurized gas can be injected into a piston rod packing unit of a reciprocating compressor to provide gas lubrication and a gas seal in the piston rod packing unit. Alternatively or in combination, the externally pressurized gas can be injected into a piston of the reciprocating compressor to provide gas lubrication for the cylinder of the reciprocating compressor.

The externally pressurized gas seal and gas lubrication disclosed herein provide a zero fugitive emission of process gas and compressed gas from the piston rod packing unit during operation of a reciprocating compressor. High pressure secondary gas, pressurized to the high pressure at a pressure source that is not the reciprocating compressor, is injected into the middle of at least one of the packing rings of the piston rod packing unit of the reciprocating compressor and is distributed to channels of the packing rings. A gas film of the secondary gas forms between the piston rod and the packing ring(s) into which the secondary gas is injected. This film provides a non-contacting gas interface that lubricates the packing ring(s), provides a gas seal that prevents process gas or compressed gas from the cylinder from leaking from the piston rod packing unit, and allows for near frictionless operation with no design life limitations. The secondary gas pressure is a higher pressure than the compression pressure in the cylinder. The packing in the piston rod packing unit is designed for the thermal growth of the piston rod without contacting the piston rod during the reciprocating motion. When the reciprocating compressor is shut down and the pressure to the packing is blocked in (e.g., the flow of the secondary gas to the piston rod packing unit is stopped), the packing can also form a tight seal between the piston rod and the packing, resulting in zero fugitive emissions while shut down. The amount of secondary gas needed to accomplish these advantages can be minimized by injecting the secondary gas into the packing ring closest to the crank side of the piston rod packing unit and injecting a process compatible gas into the rest of the packing rings. The process compatible gas, also at a high pressure, provides gas lubrication to the respective packing rings, and can also provide a gas seal to prevent passage of process gas or compressed gas from the cylinder into the piston rod packing unit of the reciprocating compressor.

The externally pressurized cylinder lubrication disclosed herein eliminates the need for oil lubrication of the cylinder and provides a frictionless non contacting operation of the reciprocating compressor piston and cylinder. A portion of an externally pressurized gas (e.g., either the secondary gas or the process compatible gas depending on the embodiment of the piston rod packing unit) that is injected into the piston rod packing unit can flow from the rod packing through a channel formed in the center of the piston rod (e.g., along a longitudinal axis of the piston rod). The high-pressure gas is routed into the center of the piston and is distributed into the gas permeable ring(s) on the outer diameter of the piston assembly. The gas permeable ring(s) replaces the existing piston rings/rider band. The gas permeable ring(s) can be a solid ring or segmented with mis-matched split lines, or joints (to minimize or prevent leakage). The gas permeable ring(s) allows a thin film of gas to form between the cylinder inner diameter (ID) and the piston outer diameter (OD), providing a frictionless non-contacting gas interface for the reciprocating motion that fully supports the piston assembly. This creates a more efficient piston with no design life limitation, dramatically reducing compressor maintenance and operating cost.

Figure 1B:
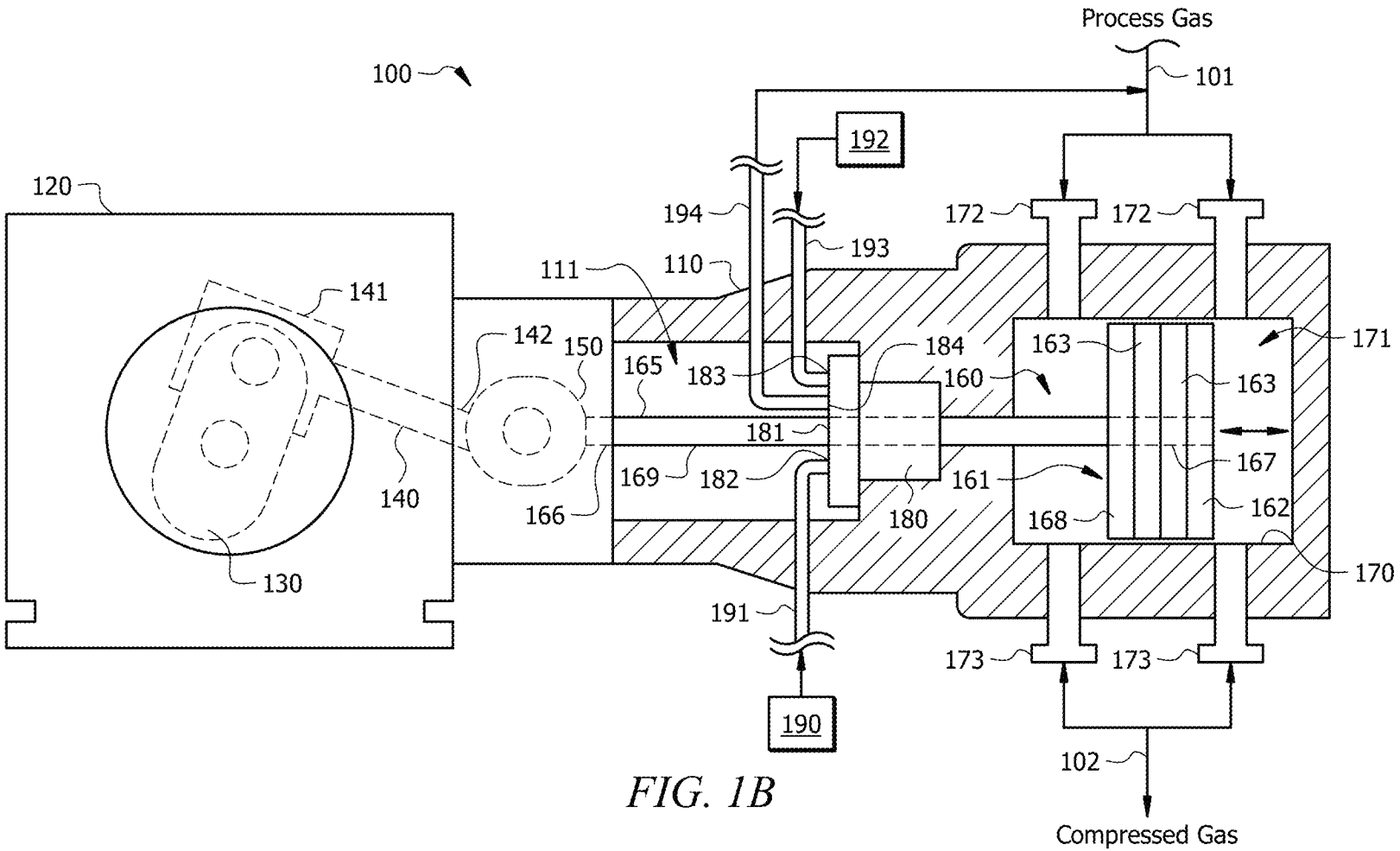
FIG. 1B illustrates a side view of a reciprocating compressor having a secondary gas supplied to the rod packing unit in combination with a process compatible gas, for gas seal and gas lubrication of the packing rings in the rod packing unit.

FIGS. 1A and 1B each illustrate a side view of a reciprocating compressor 100 according to the disclosure. It is to be generally understood that the reciprocating compressor 100 can be used as a single stage for compression of a process gas, or as one stage in multiple stages containing a series of reciprocating compressors 100 for staged compression of a process gas to a final, compression pressure.

The reciprocating compressor 100 has a housing 110 that contains various equipment of the reciprocating compressor 100. A portion of the housing 110 is cut away in FIGS. 1A and 1B, showing a portion of the housing 110 in cross-section. The cut-away portion illustrates the hollow interior 111 that contains various equipment of the cut-away portion as well as equipment drawn in dashed lines in the non-cut-away portion of the housing 110. The housing 110 also has a cylinder 170 formed therein. The housing 110 of the reciprocating compressor 100 can include one or more process gas inlet 172 (e.g., two being illustrated in FIGS. 1A and 1B) fluidly connected to the interior 171 of the cylinder 170 and one or more compressed gas outlet 173 (e.g., two being illustrated in FIGS. 1A and 1B) fluidly connected to the interior 171 of the cylinder 170. The process gas inlet(s) 172 and compressed gas outlet(s) 173 can have valves associated therewith to prevent backflow of compressed gas into the inlet(s) 172 and backflow of discharged compressed gas from the outlet(s) 173 back into the interior 171 of the cylinder 170.

A process gas (e.g., natural gas or other gas compressed by the reciprocating compressor 100) is supplied to the process gas inlet 172 by a process gas line 101 at a process pressure. The process pressure can also be referred to as a suction pressure or suction-side pressure; although, the process pressure is generally a positive pressure (as opposed to a vacuum pressure). A compressed gas is discharged from the compressed gas outlet 173 via a discharge line 102 at a compression pressure, where the compression pressure is greater than the process pressure. The discharge line 102 can be connected to another reciprocating compressor, to a pipeline, or to both.

The reciprocating compressor 100 also includes a prime mover 120, a crank shaft 130 coupled to the prime mover 120, a connecting rod 140 having an end 141 coupled to the crank shaft 130, a crosshead 150 coupled to an opposite end 142 of the connecting rod 140, a piston 160, and a piston rod packing unit 180. One or more of the prime mover 120, the crank shaft 130, the connecting rod 140, the crosshead 150, the piston 160, and the piston rod packing unit 180 are at least partially contained within the housing 110. For example, the prime mover 120, the crank shaft 130, the connecting rod 140, the crosshead 150, the piston 160, and the piston rod packing unit 180 can be completely contained in the housing 110; alternatively, the housing 110 can include two portions, one which contains the prime mover 120, the crank shaft 130, the connecting rod 140, the crosshead 150, and part of the piston rod 165 of the piston 160, while another portion of the housing 110 can contain another part of the piston rod 165 and the piston rod packing unit 180.

The piston 160 includes a piston rod 165 and a piston assembly 161 connected to the piston rod 165. The piston rod 165 has an end 166 coupled to the crosshead 150 in the interior 111 of the housing 110 and an opposite end 167 that extends into the interior 171 of the cylinder 170. The opposite end 167 is connected to the piston assembly 161. The piston rod 165 also extends through the piston rod packing unit 180 such that end 166 of the piston 160 is in the hollow interior 111 of the housing 110 and the opposite end 167 is in the interior 171 of the cylinder 170. The outer wall 169 of the piston rod 165 is the smooth outer surface that forms the cylindrical shape of the piston rod 165. A portion of the outer wall 169 of the piston rod 165 reciprocates inside the piston rod packing unit 180. The piston assembly 161 of the piston 160 includes one or more piston core 163 positioned between piston head end 162 and piston crank end 168. Two cores 163 are illustrated in FIGS. 1A and 1B; however, the disclosure contemplated that one core 163 or more than two cores 163 can be included in the piston assembly 161 of the piston 160, wherein all cores are located between the piston head end 162 and the piston crank end 168.

The piston rod packing unit 180 is configured to allow a reciprocating movement of the piston 160 therein while providing a gas seal against the piston rod 165 of the piston 160 which prevent passage of gas from the interior 171 of the cylinder 170 into the hollow interior 111 of the housing 110. The piston rod packing unit 180 is further configured to provide gas lubrication for the movement of the piston 160 therein.

In operation, the prime mover 120 (e.g., an internal combustion engine or an electric motor) is configured to turn (e.g., rotate) the crank shaft 130. The turning of the crank shaft 130 is translated into a reciprocating movement of the piston 160 through the coupling of the crank shaft 130 to the piston 160 via the connecting rod 140 and the crosshead 150. The reciprocating movement of the piston 160 is made in the interior 171 of the cylinder 170 in the direction of the double-headed arrow that is illustrated in the interior 171 of the cylinder 170 in FIGS. 1A and 1B. The cylinder 170 is configured for the longitudinal movement of the piston assembly 161 therein. The reciprocating movement of the piston assembly 161 causes process gas to be suctioned into the cylinder 170 via the inlet(s) 172 and compressed to form the compressed gas, which is discharged via the outlet(s) 173.

The piston rod packing unit 180 is configured to utilize an externally pressurized secondary gas received via the gas inlet port 182 to provide a gas seal between one or more of packing rings 203 and the piston rod 165 that prevents or reduces process gas and compressed gas in the interior 171 of the cylinder 170 from passing into the hollow interior 111 of the housing 110, while allowing reciprocating movement of the piston rod 165 of the piston 160 in the piston rod packing unit 180. The externally pressurized secondary gas (e.g., an inert gas such as nitrogen) can be injected into the piston rod packing unit 180 at a pressure that is greater than the compression pressure of the reciprocating compressor 100. The externally pressurized secondary gas creates a gas interface (e.g., a film or layer of gas, 1-10 microns thickness) between the piston rod 165 and the packing rings of the piston rod packing unit 180. The gas interface provides a gas seal in the piston rod packing unit 180 that prevents fugitive emission or leakage of process gas or compressed gas in a direction of flow from the interior 171 of the cylinder 170, through the piston rod packing unit 180, and into the hollow interior 111 of the housing 110 (and/or into the atmosphere of the Earth). In some cases, the gas seal provides zero fugitive emissions or leakage of process gas and/or compressed gas from the reciprocating compressor 100. With reduced leakage resulting is reduced emissions, greenhouse gas emissions are reduced when the process gas includes chemical species that are a greenhouse gas (e.g., such as methane).

The gas interface also provides a reduced friction operation (e.g., including near frictionless operation, e.g., 0.004 to 0.009 coefficient of friction) of the piston rod 165 in the piston rod packing unit 180, and extends the useful life of the packing rings in the piston rod packing unit 180 compared to oil-based lubrication of the packing rings. Reduced friction operation, including near frictionless operation, reduces or nearly eliminates heat that may be generated between the piston rod 165 and the piston rod packing unit 180 due to friction compared to oil-based lubrication.

In aspects, no lubricating oil is used in the piston rod packing unit 180 for seal or lubrication between the piston rod packing unit 180 and the piston rod 165.

The externally pressurized secondary gas that is supplied to the piston rod packing unit 180 in FIGS. 1A and 1B provides solutions to reduce or prevent the leakage of process gas or compressed gas from the interior 171 of the cylinder 170 into the hollow interior 111 of the housing 110. Moreover, leakage of lubricating oil from the piston rod packing unit 180 into the cylinder 170 is prevented because no oil is used to seal or lubricate the packing rings of the piston rod packing unit 180.

Referring to FIG. 1A, the externally pressurized secondary gas is supplied to the piston rod packing unit 180 to provide a gas seal against leakage of process gas or compressed gas from the piston rod packing unit 180 into the hollow interior 111 of the housing 110, and for gas lubrication of the piston rod 165 in the piston rod packing unit 180. The externally pressurized secondary gas is supplied via a secondary gas line 191 that is connected to an inlet port 182 formed in the piston rod packing unit 180. The externally pressurized secondary gas is supplied from a secondary gas source 190, such as a pressurized tank or canister that is on-site with the reciprocating compressor 100. Various valving such as check valve(s) can be included in the secondary gas line 191 to control flow of the secondary gas to the piston rod packing unit 180. The inlet port 182 is illustrated in FIG. 1A as being formed on the side 181 of the piston rod packing unit 180; however, it is contemplated that the inlet port 182 can be formed on the circumferential wall of the piston rod packing unit 180.

In aspects, the piston 160 of the reciprocating compressor 100 in FIG. 1A can include a channel formed in an interior of the piston rod 165. An inlet port formed in the piston rod 165, and in fluid communication with the channel that is formed in the piston rod 165, is additionally fluidly connected to a portion of the gas interface located between the piston rod packing unit 180 and the piston rod 165. Externally pressurized secondary gas from the gas interface in the piston rod packing unit 180 can flow into the channel of the piston rod 165. The channel in the piston rod 165 is also fluidly connected with a gas outlet port formed in the end 167 of the piston rod 165. The externally pressurized secondary gas can flow from the gas outlet port of the piston rod 165 and into piston core(s) 163 of the piston assembly 161. The externally pressurized secondary gas flows through the piston core(s) 163 to create another gas interface between the piston assembly 161 and the cylinder 170.

In operation of the reciprocating compressor 100 in FIG. 1A, the secondary gas is supplied to the inlet port 182 of the piston rod packing unit 180 at a pressure that is greater than the compression pressure present in the interior 171 of the cylinder 170 of the reciprocating compressor 100. The externally pressurized secondary gas is thus supplied from a source 190 that is external to the reciprocating compressor 100. The externally pressurized secondary gas creates the gas interface between the piston rod 165 and the piston rod packing unit 180, and also creates a gas seal against which the process gas and compressed gas in the interior 171 of the cylinder 170 cannot flow against since the pressure of the secondary gas in the gas interface is greater than the pressure of the process gas and the pressure of the compressed gas. In aspects, the secondary gas can leak in small amounts (depends on the diameter of the piston rod 165 and secondary gas pressure, e.g., from 1 to 20 liters per hour) from the side 181 of the piston rod packing unit 180, into the hollow interior 111 of the reciprocating compressor 100. The secondary gas can also flow in small amounts (e.g., secondary gas flow rate is 0.01 vol % or mol % or wt % of the process gas flow rate through the cylinder 170) through an annular space formed between an outer surface of the piston rod 165 and inner wall of the packing rings of the piston rod packing unit 180, and into the interior 171 of the cylinder 170 when the interior 171 has a pressure that is less than the secondary gas pressure (e.g., during a suction throw, in compression throw, or both, of the piston 160). The secondary gas that leaks into the interior 171 can be incorporated into the process gas, compressed, and discharged with the compressed gas via outlet 173, into the discharge line 102. In aspects that include flow of the secondary gas through the piston 160 for gas lubrication of the cylinder 170, secondary gas flows from the gas interface in the piston rod packing unit 180, through the channel of the piston rod 165, into the piston core(s) 163 of the piston assembly 161, and into a space between the piston assembly 161 and the cylinder 170 to form a gas interface (e.g., a film or layer of gas, 1-10 microns thickness) between the piston assembly 161 and the cylinder 170.

Referring to FIG. 1B, the externally pressurized secondary gas provides a gas seal to prevent leakage of process gas or compressed gas from the piston rod packing unit 180 into the hollow interior 111 of the housing 110. The secondary gas also provides gas lubrication of the piston rod 165 in a first portion of the piston rod packing unit 180. The secondary gas is utilized in combination with a process compatible gas in the piston rod packing unit 180. The process compatible gas is supplied at a pressure that is equal to or greater than the compression pressure of the reciprocating compressor 100. The process compatible gas provide gas lubrication of the piston rod 165 in a second portion of the piston rod packing unit 180.

In FIG. 1B, the externally pressurized secondary gas is supplied via the secondary gas line 191 that is connected to a first gas inlet port 182 formed in the piston rod packing unit 180. The secondary gas is supplied from the secondary gas source 190, such as a tank or canister that is on-site with the reciprocating compressor 100. Various valving such as check valve(s) can be included in the secondary gas line 191 to control flow of the secondary gas to the piston rod packing unit 180.

The process compatible gas is supplied via a compatible gas line 193 that is connected to a second gas inlet port 183 formed in the piston rod packing unit 180. The process compatible gas is supplied from a process compatible gas source 192, such as a tank or canister, or such as a stream obtained from another process proximate to the reciprocating compressor 100. The process compatible gas source 192 can alternatively or additionally include a portion of the compressed gas from discharge line 102.

A gas outlet port 184 is also formed in the piston rod packing unit 180. The gas outlet port 184 is fluidly connected to the process gas line 101 via line 194. The pressure of the gas outlet port 184 and line 194 is thus the process pressure of the process gas in line 101, on the suction side of the reciprocating compressor 100, upstream of the inlet(s) 172.

The first gas inlet port 182, the second gas inlet port 183, and the gas outlet port 184 are illustrated in FIG. 1B as being formed on the side 181 of the piston rod packing unit 180; however, it is contemplated that one or more of the first gas inlet port 182, second gas inlet port 183, and gas outlet port 184 can be formed on the circumferential wall of the piston rod packing unit 180.

In aspects of the reciprocating compressor 100 in FIG. 1B, a secondary gas interface (also referred to as a first gas interface; e.g., a film or layer of gas, 1-10 microns thickness) and a process compatible gas interface (also referred to as a second gas interface; e.g., a film or layer of gas, 1-10 microns thickness) are formed in series with respect to a longitudinal direction of the piston rod 165 and the piston rod packing unit 180, between the piston rod 165 and the piston rod packing unit 180. The first gas interface is adjacent the side 181 of the piston rod packing unit 180, serving as a gas seal to prevent leakage of process gas or compressed gas from the interior 171 of the cylinder 170 and any process compatible gas from the process compatible gas interface out of the side 181 of the piston rod packing unit 180.

In aspects, the piston 160 of the reciprocating compressor 100 in FIG. 1B can include a channel formed in an interior of the piston rod 165. An inlet port to the channel that is formed in the piston rod 165 is fluidly connected to a portion of the second gas interface located between the piston rod packing unit 180 and the piston rod 165. Pressurized process compatible gas from the second gas interface in the piston rod packing unit 180 can flow into the channel of the piston rod 165. The channel in the piston rod 165 is also fluidly connected with a gas outlet port formed in the end 167 of the piston rod 165. The pressurized process compatible gas flows from the gas outlet port and into piston core(s) 163 of the piston assembly 161. The pressurized process compatible gas flows through the piston core(s) 163 to create a third gas interface between the piston assembly 161 and the cylinder 170.

In operation of the reciprocating compressor 100 in FIG. 1B, the secondary gas is supplied to the inlet port 182 of the piston rod packing unit 180 at a pressure that is greater than the compression pressure present in the interior 171 of the cylinder 170 of the reciprocating compressor 100. The externally pressurized secondary gas is thus supplied from a source 190 that is external to the reciprocating compressor 100. The externally pressurized secondary gas creates the first gas interface between the piston rod 165 and the piston rod packing unit 180, and also creates a gas seal against which the process gas and compressed gas in the interior 171 of the cylinder 170, as well as process compatible gas from the second gas interface in the piston rod packing unit 180, cannot flow against since the pressure of the secondary gas in the first gas interface is greater than the pressure of the process gas and the pressure of the compressed gas. In aspects, the externally pressurized secondary gas can leak in small amounts (depends on the diameter of the piston rod 165 and secondary gas pressure, e.g., from 1 to 20 liters per hour) from the side 181 of the piston rod packing unit 180, into the hollow interior 111 of the reciprocating compressor 100. The secondary gas can also flow in small amounts (e.g., secondary gas flow rate is 0.01 vol % or mol % or wt % of the process gas flow rate through the cylinder 170) out of the piston rod packing unit 180 through the gas outlet port 184 of the piston rod packing unit 180.

Any of the process compatible gas that leaks into the interior 171 can be incorporated into the process gas, compressed, and discharged with the compressed gas via outlet 173, into the discharge line 102.

In aspects that include flow of the process compatible gas through the piston 160 for gas lubrication of the cylinder 170, process compatible gas flows from the second gas interface in the piston rod packing unit 180, through the channel of the piston rod 165, into the piston core(s) 163 of the piston assembly 161, and into an annular space between the piston assembly 161 and the cylinder 170 to form a third gas interface (e.g., a film or layer of gas, 1-10 microns thickness) between the piston assembly 161 and the cylinder 170.

Figure 2A:
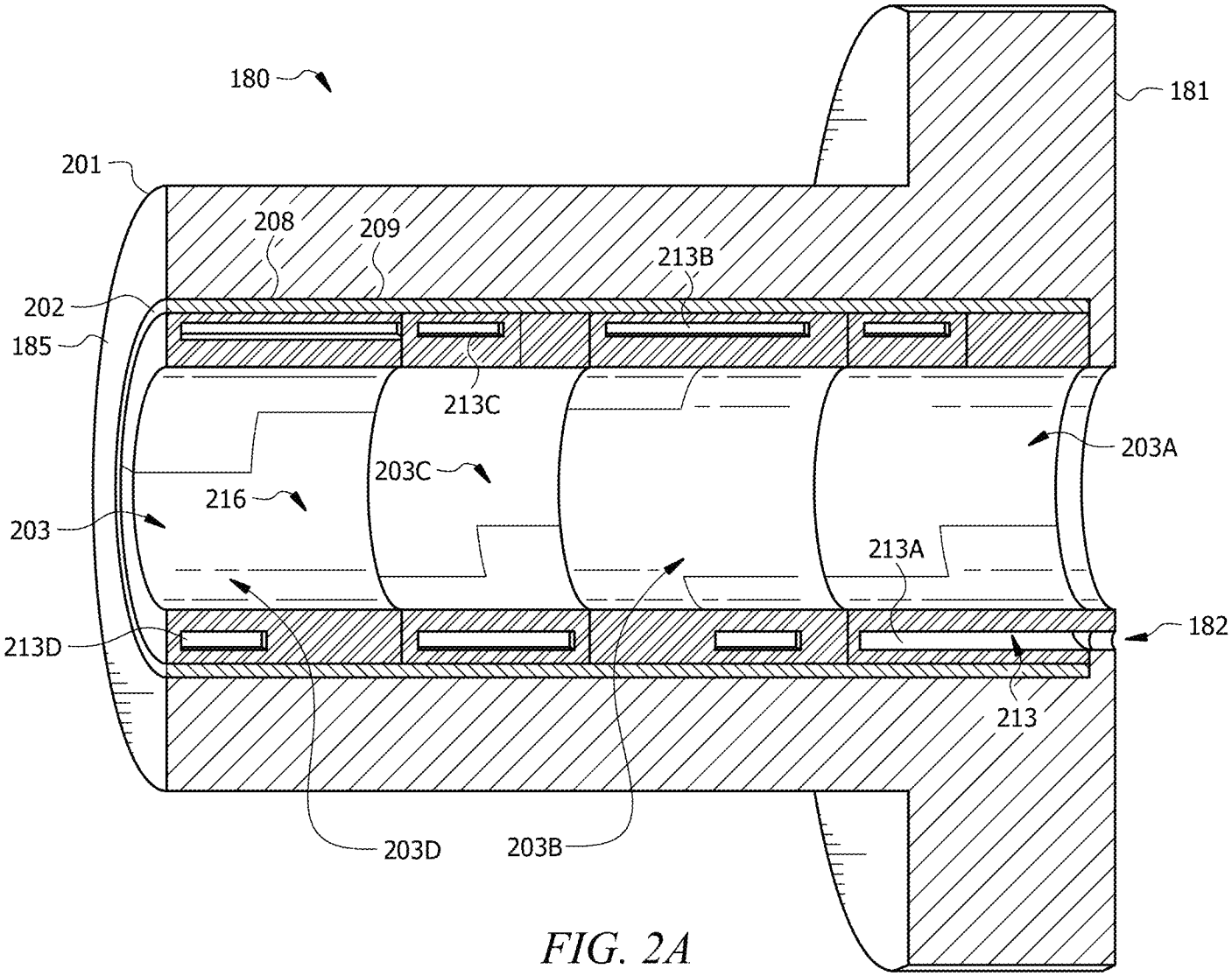
FIG. 2A illustrates a cross-section view of the piston rod packing unit of FIG. 1A.

FIG. 2A illustrates a cross-section view of the piston rod packing unit 180 of FIG. 1A. The piston rod packing unit 180 has a side 181 (referred to as a crank side because it faces the crank shaft 130 of the reciprocating compressor 100) and an opposite side 185 (referred to as the cylinder side because it faces the cylinder 170 of the reciprocating compressor 100). The piston rod packing unit 180 has a rod packing case 201. The rod packing case 201 is generally tubular in shape, with a flange on side 181. The tubular shape of the rod packing case 201 allows for positioning and movement of the piston rod 165 therein. The flange is for connecting the rod packing case 201 to the housing 110 of the reciprocating compressor 100. The rod packing case 201 has a gas inlet port 182 formed therein. The gas inlet port 182 is connected to the secondary gas line 191 in FIG. 1A. The gas inlet port 182 can be referred to as the secondary gas inlet port. In FIG. 2A, the gas inlet port 182 is bored into the side 181 of the piston rod packing unit 180. Alternatively, the gas inlet port 182 can be bored radially, for example, through the flange of the rod packing case 201.

The piston rod packing unit 180 also has a compression sleeve 202 placed within the rod packing case 201. The compression sleeve 202 is also a tubular structure (like the rod packing case 201). An outer wall 208 of the compression sleeve 202 contacts an inner wall 209 of the rod packing case 201.

The piston rod packing unit 180 also has a plurality of packing rings 203 placed within the compression sleeve 202. Each of the plurality of packing rings 203 is configured to surround the outer wall 169 of the piston rod 165 such that an inner wall 216 of each of the plurality of packing rings 203 faces the portion of the outer wall 169 of the piston rod 165 that reciprocates inside the piston rod packing unit 180. Each of the plurality of packing rings 203 has a permeable flowpath, a channel 213, or both a permeable flowpath and a channel 213 formed therein for passage of the secondary gas from the gas inlet port 182, into the channels 213, and to an annular space formed between the inner wall 216 of the packing rings 203 and the outer wall 169 of the piston rod 165 such that a gas interface is formed for lubrication of the reciprocating movement of the piston rod 165 in the plurality of packing rings 203 of the piston rod packing unit 180. While four packing rings 203A, 203B, 203C, and 203D are illustrated in FIG. 2A, it is contemplated that more or fewer packing rings can be included in the piston rod packing unit 180, depending on the longitudinal length of the packing rings 203 and the longitudinal length of the rod packing case 201. Each of the plurality of packing rings 203 has the same thickness, inner diameter, and outer diameter. The plurality of packing rings 203 are generally placed in series such that they are side-by-side. For example, packing ring 203A is next to packing ring 203B, and packing ring 203B is next to packing ring 203A and 203C, packing ring 203C is next to packing ring 203B and 203D.

The gas inlet port 182 fluidly connects with the channel 213 of at least one of the plurality of packing rings 203. In FIG. 2A, the gas inlet port 182 is in fluid communication with gas distribution channel 213A formed in the first packing ring 203A.

In aspects, the plurality of packing rings 203 can be formed of a gas permeable material; alternatively, the plurality of packing rings 203 can be formed of a gas impermeable material; alternatively, one or more of the plurality of packing rings 203 can be formed of a gas permeable material and one or more of the plurality of packing rings 203 can be formed of a gas impermeable material.

The gas permeable material can be a solid material that is permeable to the secondary gas at such a permeation rate that a gas interface can be formed of the secondary gas between the inner wall 216 of the plurality of packing rings 203 and the piston rod 165 due to permeation of the secondary gas through one or more of the plurality of packing rings 203. For example, the gas permeable material can be a porous media formed from a porous carbon-based material, a porous ceramic material, a porous metal matrix material, a porous polymer, or combinations thereof. In the gas permeable material, the particles of the gas permeable material are generally spaced from one another at a particle-to-particle distance that is larger than the size of the molecules of the secondary gas, such that permeable flowpaths for flow of the secondary gas are present in the gas permeable material.

The gas impermeable material can be a solid material that is impermeable to the secondary gas such that there is no permeation rate through the solid material which could form the gas interface described herein. Instead, gas distribution channels and indentations are formed as described in such configured packing rings, as described in more detail in the description for FIG. 4. The solid material can be any suitable solid configured for functioning as a packing ring for the piston rod of a reciprocating compressor, such as a metal or polymer known in the art with the aid of this disclosure for use with reciprocating compressors.

In FIG. 2A, each of the plurality of packing rings 203 is formed of a gas permeable material and has a channel 213 formed in the permeable material. Thus, each of the plurality of packing rings 203 has a permeable flowpath and a channel 213 formed therein for passage of the secondary gas therethrough.

The gas inlet port 182 is in fluid communication with the first packing ring 203A. FIG. 2A illustrates that the plurality of packing rings 203 formed of a gas permeable material can also having channels 213 formed therein. The channels 213 facilitate flow of the secondary gas within the plurality of packing rings 203 for permeation to the inner wall 216 of the plurality of packing rings 203.

In FIG. 2A, the gas inlet port 182 is in fluid communication with gas distribution channel 213A formed in the first packing ring 203A. The gas distribution channel 213A of the first packing ring 203A is in fluid communication with the gas distribution channel 213B of the second packing ring 203B. The gas distribution channel 213B of the second packing ring 203B is in fluid communication with the gas distribution channel 213C of the third packing ring 203C. The gas distribution channel 213C of the third packing ring 203C is in fluid communication with the gas distribution channel 213D of the fourth packing ring 203D.

The secondary gas can flow (at injection pressure that is greater than the compression pressure in the cylinder 170) through the gas inlet port 182, through the gas distribution channels 213A, 213B, 213C, and 213D of the packing rings 203A, 203B, 203C, 203D, through the gas permeable material of each of the packing rings 203A, 203B, 203C, and 203D, and to the inner wall 216 of the plurality of packing rings 203—such that the secondary gas occupies the annular space between the inner wall 216 of the plurality of packing rings 203 of the outer wall 169 of the piston rod 165, thus creating the gas interface for gas lubrication of the piston rod packing unit 180. The pressure of the gas interface is the injection pressure.

The gas interface formed by the secondary gas at injection pressure also functions as and forms a gas seal. The gas seal prevents entry of process gas or compressed gas from the interior 171 of the cylinder 170 into the piston rod packing unit 180. The seal pressure of the secondary gas in the gas seal is the injection pressure of the secondary gas. Because the seal pressure is greater than the compression pressure of the reciprocating compressor 100, secondary gas can flow from the piston rod packing unit 180 into interior 171 of the cylinder 170 during operation of the reciprocating compressor 100, but process gas and compressed gas cannot flow from the interior 171 of the cylinder 170 into the piston rod packing unit 180.

The secondary gas may slowly flow from the gas interface in the piston rod packing unit 180 and out of the piston rod packing unit 180 on side 181. This flow is the leakage of secondary gas that replaces the leakage of process gas or compressed gas that can occur without the secondary gas seal and gas interface. The gas seal created by the secondary gas prevents leakage of process gas or compressed gas (e.g., containing any greenhouse gases) from the piston rod packing unit 180 of the reciprocating compressor 100.

In aspects, the compression sleeve 202 in combination with the plurality of packing rings 203 contained in the compression sleeve 202 can be referred to as a packing cartridge. In, FIG. 2A, a single packing cartridge is illustrated.

Figure 2B:
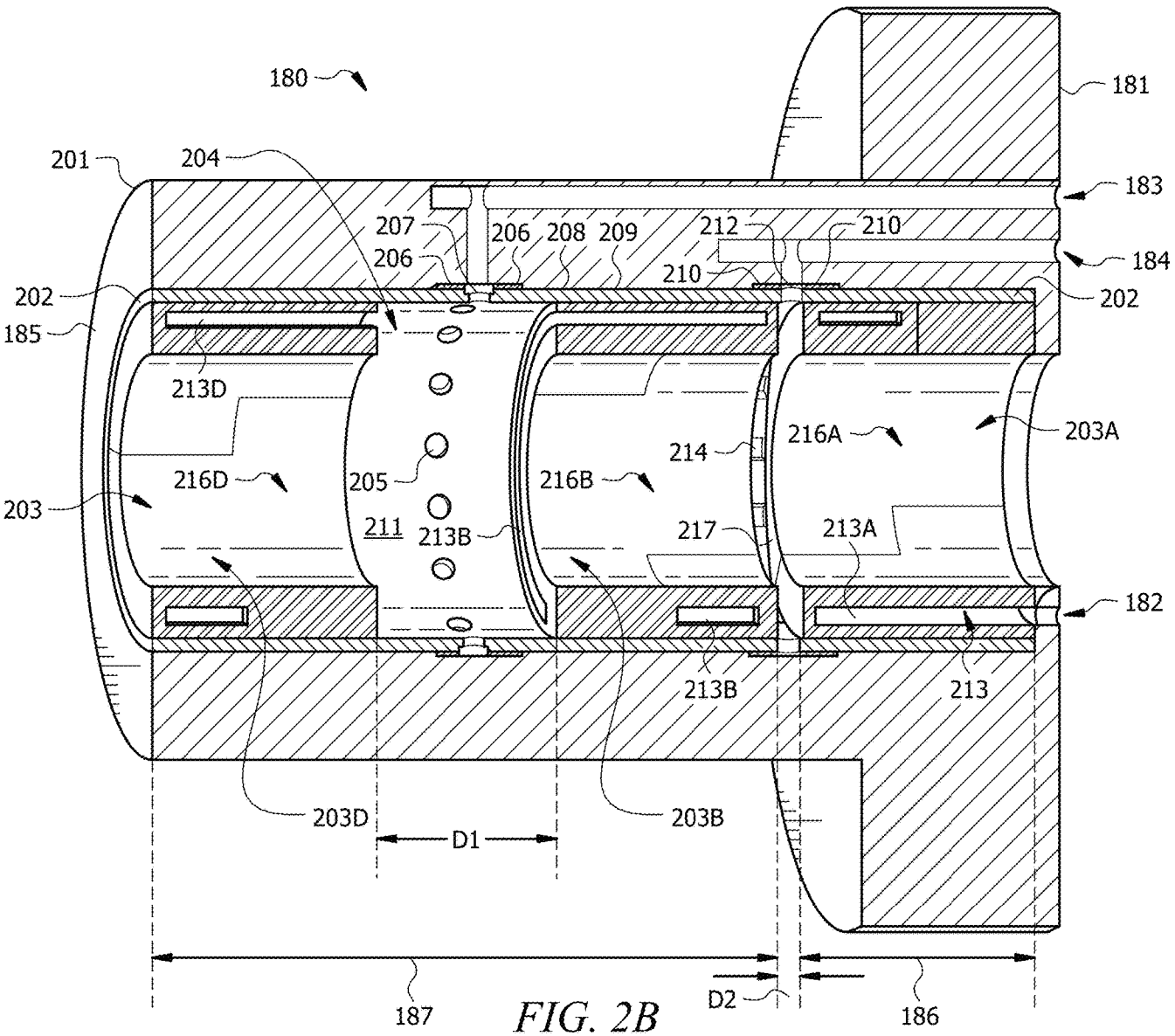
FIG. 2B illustrates a cross-section view of the piston rod packing unit of FIG. 1B.

FIG. 2B illustrates a cross-section view of the piston rod packing unit 180 of FIG. 1B. The piston rod packing unit 180 has a side 181 (referred to as a crank side because it faces the crank shaft 130 of the reciprocating compressor 100) and an opposite side 185 (referred to as the cylinder side because it faces the cylinder 170 of the reciprocating compressor 100). The piston rod packing unit 180 has a rod packing case 201. The rod packing case 201 is generally tubular in shape, with a flange on side 181. The tubular shape of the rod packing case 201 allows for positioning and movement of the piston rod 165 therein. The flange is for connecting the rod packing case 201 to the housing 110 of the reciprocating compressor 100. The rod packing case 201 has a first gas inlet port 182, a second gas inlet port 183, and a gas outlet port 184 (also referred to as a reference port) formed therein.

The first gas inlet port 182 is connected to the secondary gas line 191 in FIG. 1B, the second gas inlet port 183 is connected to the process compatible gas line 193 in FIG. 1B, and the gas outlet port 184 is connected to the line 194. The first gas inlet port 182 can be referred to as the secondary gas inlet port, the second gas inlet port 183 can be referred to as the process compatible gas inlet port, and the gas outlet port 184 can be referred to as the reference port.

In FIG. 2B, the first gas inlet port 182, the second gas inlet port 183, and the gas outlet port 184 are bored into the side 181 of the piston rod packing unit 180. Alternatively, one or more of the first gas inlet port 182, the second gas inlet port 183, and the gas outlet port 184 can be bored radially, for example, through the flange of the rod packing case 201.

The piston rod packing unit 180 has compression sleeve 202 placed within the rod packing case 201. The compression sleeve 202 is a tubular structure (like the rod packing case 201). An outer wall 208 of the compression sleeve 202 contacts an inner wall 209 of the rod packing case 201.

Compression seals 206 extend around the compression sleeve 202 so as to form an annular channel 207 between the outer wall 208 of the compression sleeve 202 and the inner wall 209 of the rod packing case 201. The compression sleeve 202 has holes 205 formed therein, where each hole 205 is in fluid communication with the annular channel 207. The annular channel 207 is also in fluid communication with the second gas inlet port 183. No packing ring is placed over holes 205 in the compression sleeve 202 such that annular space 204 is formed between the inner wall 211 of the compression sleeve 202 and the piston rod 165. More particularly, the annular space 204 is formed between the inner wall 211 of a portion of the compression sleeve 202 where the holes 205 are present and the portion of the piston rod 165 that reciprocates in the annular space 204. A longitudinal distance D1 of the annular space 204 can correspond to the length of the "throw" of the piston 160. The "throw" is the distance the piston 160 travels in the reciprocating movement in the reciprocating compressor 100. As is described in more detail below, the piston 160 can include a gas inlet port in the piston rod 165, and the longitudinal distance D1 of the annular space 204 is sized such that the gas inlet port of the piston rod 165 is contained within the annular space 204 for all reciprocating movement of the piston rod 165 in the piston rod packing unit 180.

In aspects, the annular space 204 can be referred to as a high-pressure gas pocket or process compatible gas pocket.

Compression seals 210 extend around the compression sleeve 202 so as to form an annular channel 212 between the outer wall 208 of the compression sleeve 202 and the inner wall 209 of the rod packing case 201. The compression sleeve 202 has holes 214 formed therein, where each hole 214 is in fluid communication with the annular channel 212. The annular channel 212 is also in fluid communication with the gas outlet port 184. No packing ring is placed over holes 214 in the compression sleeve 202 such that annular space 217 is formed between the inner wall 211 of the compression sleeve 202 and the piston rod 165. More particularly, the annular space 217 is formed between the inner wall 211 of a portion of the compression sleeve 202 where the holes 214 are present and the portion of the piston rod 165 that reciprocates in the annular space 217. A longitudinal distance D2 of the annular space 217 can correspond to the diameter of the annular channel 212 or the diameter of the gas inlet port 182, for example.

In aspects, the annular space 217 can be referred to as a reference pressure gas pocket or low-pressure gas pocket.

The piston rod packing unit 180 also has a plurality of packing rings 203 placed within the compression sleeve 202. In aspects, no portion of any of the plurality of packing rings 203 is placed over the annular space 204 (high-pressure gas pocket) or annular space 217 (reference pressure gas pocket or low pressure gas pocket). Each of the plurality of packing rings 203 is configured to surround the outer wall 169 of the piston rod 165 such that an inner wall 216 of each of the plurality of packing rings 203 faces the outer wall 169 of the piston rod 165.

Each of the plurality of packing rings 203 has a permeable flowpath, a channel 213, or both a permeable flowpath and a channel formed therein for passage a gas therethrough. In FIG. 2B, each of the plurality of packing rings 203 is formed of a gas permeable material and has a channel 213 formed in the permeable material. Thus, each of the plurality of packing rings 203 has a permeable flowpath and a channel 213 formed therein for passage of the secondary gas therethrough.

In aspects, the first packing ring 203A has a permeable flowpath and channel 213A formed therein for passage of the secondary gas therethrough. The channel 213A is in fluid communication with the first gas inlet port 182. The channel 213A can facilitate flow of the secondary gas within the packing ring 203A for permeation to the inner wall of the packing ring 203A. The secondary gas can flow at injection pressure into the channel 213A, through the permeable flowback, to an annular space formed between the inner wall 216 of the packing ring 203A and the outer wall 169 of the piston rod 165 such that a first gas interface (comprised of the secondary gas) is formed for lubrication of the reciprocating movement of the piston rod 165 in the packing ring 203A.

The packing ring 203A in combination with the portion of the compression sleeve 202 that contains the first packing ring 203A can be referred to as a first cartridge. The one packing ring 203A is illustrated in the first cartridge (or secondary gas cartridge) of in FIG. 2B; however, it is contemplated that more than one packing ring can be included in first cartridge.

At least a portion of the secondary gas flows from the first gas interface to the annular space 217 (the low pressure gas pocket or reference pressure gas pocket), and out of the piston rod packing unit 180 via the gas outlet port 184. In aspects, another portion of the secondary gas flows from the first gas interface out of the side 181 of the piston rod packing unit 180 and into the interior 111 of the housing 110 of the reciprocating compressor 100.

Two other packing rings 203B and 203D are illustrated in FIG. 2B. The second packing ring 203B is positioned next to the annular space 204 filled by the process compatible gas and the annular space 217 filled by the secondary gas. In aspects, the packing ring 203B has a permeable flowpath and channel 213B formed therein for passage of the process compatible gas therethrough. The channel 213B can facilitate flow of the secondary gas within the packing ring 203B for permeation to the inner wall 216B of the packing ring 203B. In aspects, the packing ring 203D has a permeable flowpath and channel 213D for passage of the process compatible gas therethrough. The channel 213D can facilitate flow of the secondary gas within the packing ring 203D for permeation to the inner wall 216D of the packing ring 203D.

The packing rings 203B and 203D in combination with the portion of the compression sleeve 202 that contains the packing rings 203B and 203D can be referred to as a second cartridge (or process compatible gas cartridge). The second cartridge is on the opposite side of the annular space 217 (low pressure gas pocket or reference pressure gas pocket) as the side on which the first cartridge is located. One packing ring 203B is illustrated on the outlet port side of the cartridge and one packing ring 203D is illustrated on the piston side of the second cartridge. However, it is contemplated that more than one packing ring can be included on the outlet port side of the second cartridge and/or more than one packing ring can be included on the piston side of the second cartridge, e.g., depending on the longitudinal length of the packing rings 203 and the longitudinal length of the rod packing case 201.

The first gas inlet port 182 (the inlet port for the secondary gas) fluidly connects with the channel 213A of the first packing ring 203A in the first cartridge (the secondary gas cartridge or the crank side cartridge). The second gas inlet port 183 (the inlet port for the process compatible gas) fluidly connects, via the annular space 204, with the channel 213B of the packing ring 203B in the second cartridge (the packing ring 203B can be referred to as the crank-side packing ring of the second cartridge, and the second cartridge also can be referred to as the process compatible gas cartridge or the piston side cartridge). The second gas inlet port 183 also fluidly connects, via the annular space 204, with the channel 213D of the packing ring 203D in the second cartridge (the packing ring 203D can be referred to as the piston-side packing ring of the second cartridge).

In aspects, the plurality of packing rings 203 can be formed of a gas permeable material; alternatively, the plurality of packing rings 203 can be formed of a gas impermeable material; alternatively, one or more of the plurality of packing rings 203 can be formed of a gas permeable material and one or more of the plurality of packing rings 203 can be formed of a gas impermeable material. The gas permeable material and gas impermeable material are described above.

In FIG. 2B, each of the plurality of packing rings 203 is formed of a gas permeable material.

The secondary gas can flow (at injection pressure that is greater than the compression pressure in the cylinder 170) through the gas inlet port 182, through the gas distribution channel 213A of the packing ring 203A, through the gas permeable material of the packing ring 203A, and to the inner wall 216A of the packing ring 203A—such that the secondary gas occupies the annular space between the inner wall 216A of the packing ring 203A of the outer wall 169 of the piston rod 165, thus creating the first gas interface for gas lubrication of the piston rod packing unit 180. The pressure of the first gas interface is the injection pressure.

The first gas interface formed by the secondary gas at injection pressure within packing ring 203A also functions as and forms a first gas seal in the piston rod packing unit 180. The first gas seal prevents leakage of the process compatible gas from the packing ring 203B out of the piston rod packing unit 180.

The seal pressure of the secondary gas in the first gas seal is the injection pressure of the secondary gas. Because the seal pressure is greater than the pressure in the annular space 217 (the low pressure pocket), secondary gas can flow from the piston rod packing unit 180 into the annular space 217 during operation of the reciprocating compressor 100, but process compatible gas cannot flow from annular space 217 to leak out the side 181 of the piston rod packing unit 180 via the first packing ring 203A.

The second gas interface formed by the process compatible gas at injection pressure within packing ring 203D also functions as and forms a second gas seal in the piston rod packing unit 180. The second gas seal prevents entry of process gas and/or compressed gas from the interior 171 of the cylinder 170 into the piston rod packing unit 180. The seal pressure of the process compatible gas in the second gas seal is the injection pressure of the process compatible gas. Because the seal pressure is greater than the compression pressure of the reciprocating compressor 100, the process compatible gas can flow from the piston rod packing unit 180 into interior 171 of the cylinder 170 during operation of the reciprocating compressor 100, but process gas and compressed gas cannot flow from the interior 171 of the cylinder 170 into the piston rod packing unit 180.

In aspects, the injection pressure of the secondary gas can be the same as the injection pressure of the process compatible gas. Alternatively, the injection pressure of the secondary gas is less than or greater than the injection pressure of the process compatible gas. In all embodiments, the injection pressure of the secondary gas and the injection pressure of the process compatible gas into the piston rod packing unit 180 are greater than the pressure in the annular space 217 (the low-pressure gas pocket).

The secondary gas may slowly flow from the gas interface in the piston rod packing unit 180 and out of the piston rod packing unit 180 on side 181. This flow is the leakage of secondary gas that replaces the leakage of process gas or compressed gas that can occur without the secondary gas seal and first gas interface and the process compatible gas seal and second gas interface. The gas seal created by the secondary gas and the gas seal created by the process compatible gas prevent leakage of process gas or compressed gas (e.g., containing any greenhouse gases) from the side 181 of the piston rod packing unit 180 of the reciprocating compressor 100. The gas seal created by the secondary gas prevents leakage of process compatible gas (e.g., containing any greenhouse gas) from the side 181 of the piston rod packing unit 180.

In operation, externally pressurized secondary gas flows into the first gas inlet port 182 and through the packing ring 203A to form the first gas interface, while externally pressurized process compatible gas flows in to the second gas inlet port 183, through the holes 205 in the compression sleeve 202, into the annular space 204, and through the packing rings 203B and 203D to form the second gas interface. In aspects, the second gas interface has two portions that are separate from one another—the first portion that is formed in the packing ring 203B and the second portion that is formed in the packing ring 203D.

Still during operation, the gas outlet port 184 is fluidly connected to inlet 172 (e.g., via the process gas line 101) of the reciprocating compressor 100, which is at a process pressure that is lower than the injection pressure of the secondary gas and the injection pressure of the process compatible gas into the piston rod packing unit 180. The pressure in the annular space 217 is thus a pressure sink in the piston rod packing unit 180. Secondary gas injected into the piston rod packing unit 180 flows, via pressure differential toward the pressure sink in the annular space 217, toward the annular space 217, via the packing ring 203A. Secondary gas can enter the annular space 217 via the permeable flowpath in packing ring 203A (for packing ring 203A embodied with gas permeable material), via the channel 213A of the packing ring 203A, via the gas interface formed between the inner wall 216A of the packing ring 203A and the outer wall 169 of the piston rod 165, or a combination thereof. Similarly, process compatible gas injected into the piston rod packing unit 180 flows, via pressure differential toward the pressure sink in the annular space 217, toward the annular space 217, via the packing ring 203B. Process compatible gas can enter the annular space 217 via the permeable flowpath in packing ring 203B (for packing ring 203B embodied with gas permeable material), via the channel 213B of the packing ring 203B, via the gas interface formed between the inner wall 216B of the packing ring 203B and the outer wall 169 of the piston rod 165, or a combination thereof. The secondary gas and process compatible gas that reach the annular space 217 can flow through the holes 214 of the compression sleeve 202, and out of the gas outlet port 184 of the piston rod packing unit 180.

Figure 3:
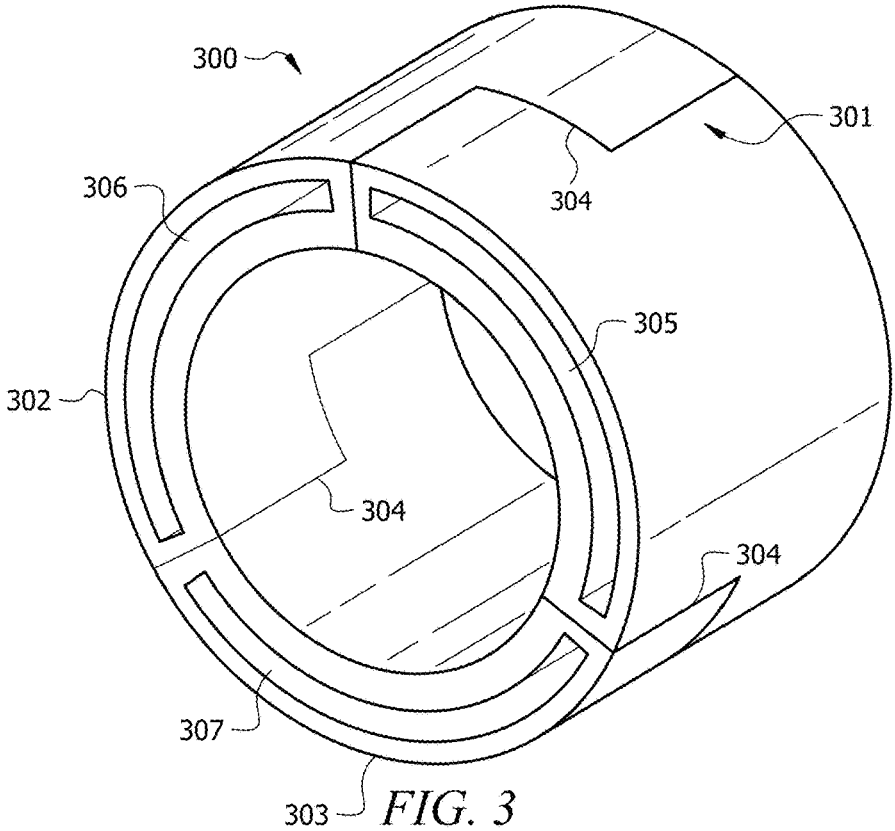
FIG. 3 illustrates a perspective view of a packing ring formed of a gas permeable material.

FIG. 3 illustrates a perspective view of a packing ring 300 formed of a gas permeable material. Any of the packing rings 203A, 203B, 203C, and 203D from FIGS. 2A and 2B can be embodied as the packing ring 300 in FIG. 3. The packing ring 300 is illustrated as being segmented. The segmented packing ring 300 has three segments: first segment 301, second segment 302, and third segment 303. While three segments 301, 302, and 303 are shown in FIG. 3, it is contemplated that any packing ring disclosed herein can have any number of segments, such as 1, 2, 4, or 5 segments, or even zero segments which would mean that the packing ring 300 is a single unitary body. When segmented, it can be seen that each segment includes a channel formed therein: first segment 301 includes a channel 305 formed therein, second segment 302 include channel 306 formed therein, and third segment 303 includes channel 307 formed therein. The gas flowing through the packing ring 300 has a permeable flowpath through the material itself and through the channels 305, 306, and 307. The segments 301, 302, and 303 fit together at joints 304 to form the packing ring 300. Joints 304 are illustrated having an offset "L" shape; however, it is contemplated that joints 304 can have any other shape, including a combination of shapes. The channel 305 in the first segment 301 can be fluidly connected with the channel 306 of the second segment 302 and the channel 307 of the third segment 303. The channel 306 of the second segment 302 can also be fluidly connected with the channel 307 of the third segment 303.

Figure 4:
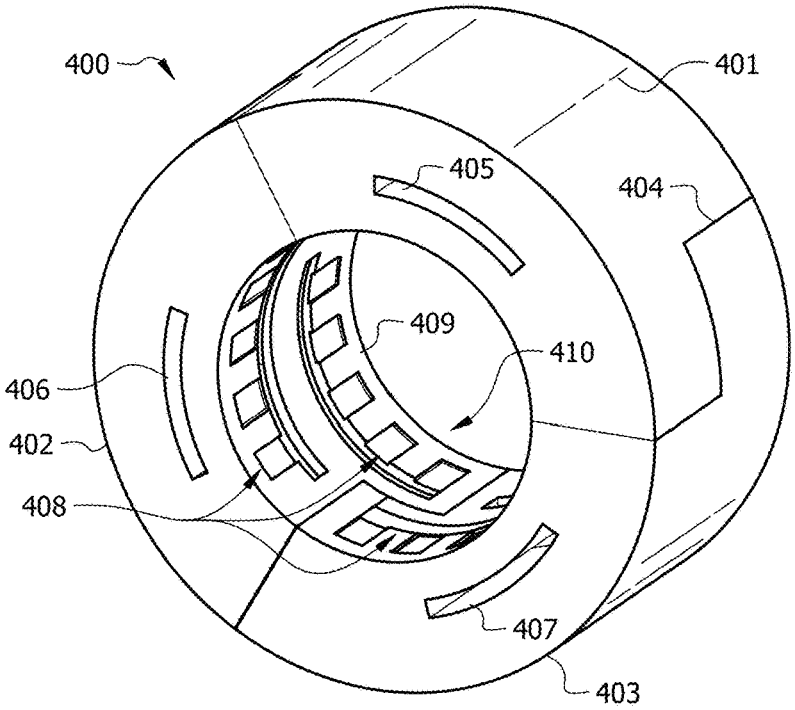
FIG. 4 illustrates a perspective view of a packing ring formed of a gas impermeable material and having recesses formed in an inner wall of the packing ring.

FIG. 4 illustrates a perspective view of a packing ring 400 formed of a gas impermeable material and having recesses 408 formed in an inner wall 409 of the packing ring 400. Any of the packing rings 203A, 203B, 203C, and 203D from FIGS. 2A and 2B can be embodied as the packing ring 400 in FIG. 4. The packing ring 400 is illustrated as being segmented. The segmented packing ring 400 has three segments: first segment 401, second segment 402, and third segment 403. While three segments 401, 402, and 403 are shown in FIG. 4, it is contemplated that any packing ring disclosed herein can have any number of segments, such as 1, 2, 4, or 5 segments, or even zero segments which would mean that the packing ring 400 is a single unitary body. When segmented, it can be seen that each segment includes a channel formed therein: first segment 401 includes a channel 405 formed therein, second segment 402 include channel 406 formed therein, and third segment 403 includes channel 407 formed therein. The gas flowing through the packing ring 400 has no permeable flowpath through the material itself, and in contrast to the channel 305, 306, and 307 of packing ring 300, the gas flowing through the packing ring 400 only flows through channels 405, 406, and 407. The segments 401, 402, and 403 fit together at joints 404 to form the packing ring 300. Joints 404 are illustrated having an offset "L" shape; however, it is contemplated that joints 404 can have any other shape, including a combination of shapes. The channel 405 in the first segment 401 can be fluidly connected with the channel 406 of the second segment 402 and the channel 407 of the third segment 403. The channel 406 of the second segment 402 can also be fluidly connected with the channel 407 of the third segment 403. The recesses 408 formed on the inner wall 409 of the packing ring 400 are all fluidly connected to one or more of the channels 405, 406, and 407. Gas flowing into the packing ring 400 flows into the channels 405, 406, and 407, and into the recesses 408 from the channels 405, 406, and 407, to form a gas interface between the inner wall 409 of the packing ring 400 and the outer wall 169 of the piston rod 165 that reciprocates movements in the interior 410 of the packing ring 400.

Figure 5:
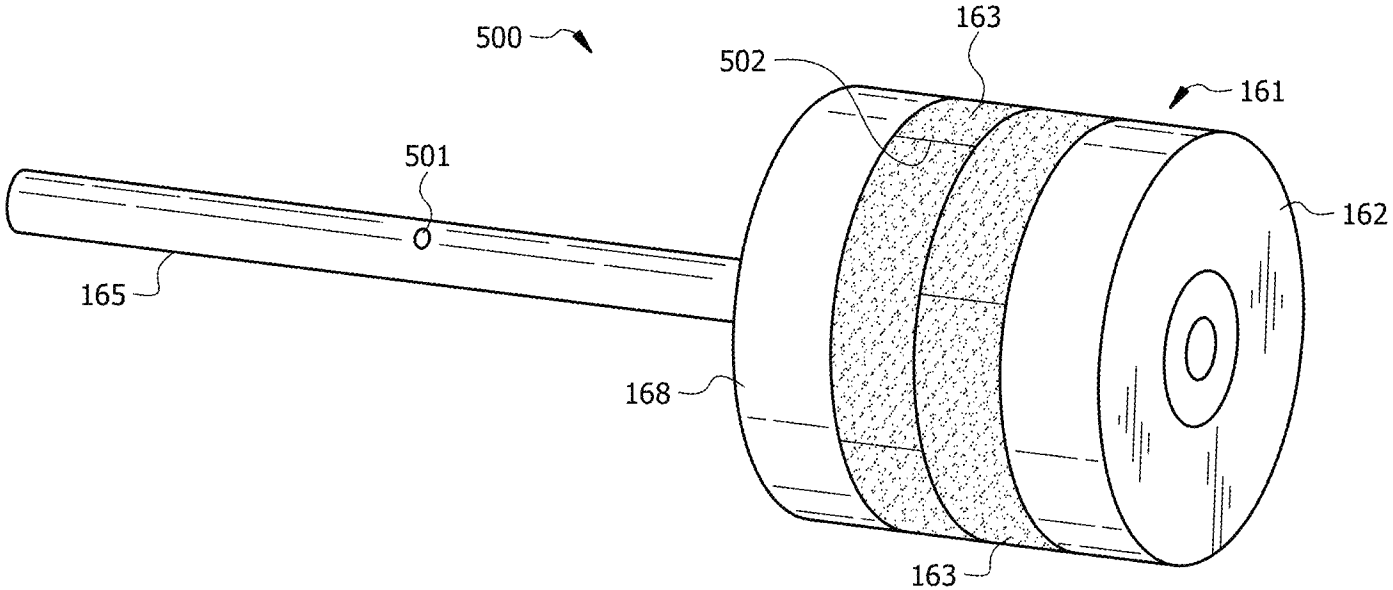
FIG. 5 illustrates a perspective view of a piston configured for gas lubrication.

FIG. 5 illustrates a perspective view of a piston 500 configured for gas lubrication of the cylinder 170 of the reciprocating compressor 100. The piston 500 is configured such that an externally pressurized gas (e.g., the secondary gas, a process compatible gas) is supplied to interior gas flow channels formed in the piston 500 such that the gas flows through the interior of the piston 500 to form a gas interface between the piston assembly and the cylinder 170 of the reciprocating compressor 100.

In aspects, the piston 160 in FIGS. 1A and 1B can be embodied as piston 500 in FIG. 5.

The piston 500 can include the piston assembly 161 the piston rod 165. The piston assembly 161 includes the piston head end 162, the piston cores 163, and the piston crank end 168. The piston 500 has a gas inlet port 501 formed in the piston rod 165. The gas inlet port 501 fluidly connects with a channel that is formed in the interior of the piston rod 165, which is described in more detail in the description for FIG. 6. The distance between the piston assembly 161 and the gas inlet port 501 is not drawn to scale in FIG. 5, and the gas inlet port 501 is located on the piston rod 165 at a location such that the gas inlet port 501 remains in the piston rod packing unit 180 to receive the externally pressurized gas during the reciprocating movement of the piston 500 in the reciprocating compressor 100. The joints 502 indicate that the piston cores 163 are segmented, as described in more detail herein. Two piston cores 163 are illustrated in the piston assembly 161 of FIG. 5; however, it is contemplated that any number of cores can be used, such as 1, 2, 3, 4, 5, 6, 7, 8, 9, or 10 piston core(s) 163.

Figure 6:
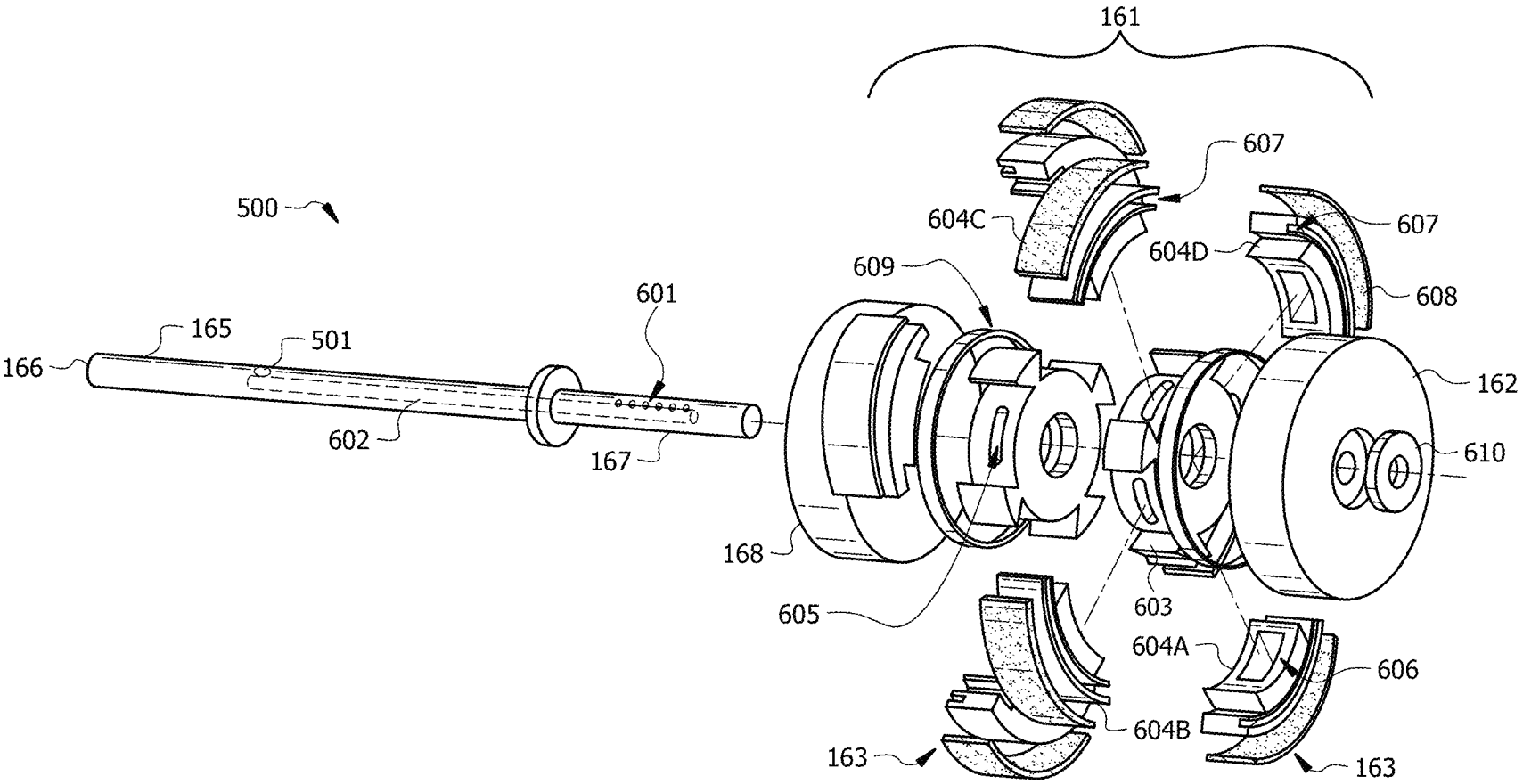
FIG. 6 illustrates an exploded perspective view of the piston of FIG. 5.

FIG. 6 illustrates an exploded perspective view of the piston 500 of FIG. 5. It can be seen that gas distribution ports 601 are formed in the end 167 of the piston rod 165 of the piston 500. Six distribution ports 601 are illustrated; however, it is contemplated that more or fewer gas distribution ports 601 can be included in the piston 500. The channel 602 formed in the piston rod 165 is illustrated with dashed lines. The channel 602 is fluidly connected to the gas inlet port 501 and the gas distribution ports 601. The externally pressurized gas that is supplied to the gas inlet port 501 can flow into the channel 602, through the channel 602 to the gas distribution ports 601, and out of the piston rod 165 via the gas distribution ports 601.

Each piston core 163 includes a gas distribution core 603, piston segment 604A, piston segment 604B, piston segment 604C, piston segment 604D, a gas permeable ring 608, and a compression ring 609. The gas distribution core 603 has a gas distribution channel 605 formed therein that is configured to distribute the gas received from the gas distribution ports 601 of the piston rod 165 to the piston segments 604A, 604B, 604C, and 604D. Each piston segment 604A, 604B, 604C, and 604D has corresponding gas distribution channel 606 formed therein for passage of the externally pressurized gas to the gas permeable ring 608. A compression ring groove 607 is formed in each piston segment 604A, 604B, 604C, and 604D, configured to receive a compression ring 609. The compression ring 609 is configured to fit in the groove 607 collectively formed by the assembled segments 604A, 604B, 604C, and 604D, to hold the segments 604A, 604B, 604C, and 604D together on the gas distribution core 603 of the piston core 163.

The gas permeable ring 608 is illustrated in segments in FIG. 6 corresponding to the piston segments 604A, 604B, 604C, and 604D. Alternatively, the gas permeable ring 608 can be a unitary piece of material that is placed around the assembled piston core 163. The gas permeable ring 608 can be formed of a gas permeable material. The gas permeable material can be a solid material that is permeable to the secondary gas or the process compatible gas (whichever is supplied as the externally pressurized gas) at such a permeation rate that a gas interface can be formed of the externally pressurized gas between the cylinder 170 and the piston assembly 161 due to permeation of the externally pressurized gas through the piston core 163. For example, the gas permeable material of the gas permeable ring 608 can be a porous media formed from a porous carbon-based material, a porous ceramic material, a porous metal matrix material, a porous polymer, or combinations thereof. In the gas permeable material, the particles of the gas permeable material are generally spaced from one another at a particle-to-particle distance that is larger than the size of the molecules of the externally pressurized gas (e.g., the secondary gas, the process compatible gas, or both), such that permeable flowpaths for flow of the externally pressurized gas are present in the gas permeable material of the gas permeable ring 608 of the piston 160.

The gas inlet port 501, gas distribution ports 601, channel 602, gas distribution channel 605, and gas distribution channel 606 collectively provide a flowpath for the externally pressurized gas to flow from the piston rod 165 of the piston 160 to the gas permeable ring 608 of the piston assembly 161 of the piston 160. The gas permeable ring 608 provides a permeable flowpath for continued flow of the externally pressurized gas to form a gas interface between the cylinder 170 and the piston assembly 161 of the piston 160.

FIG. 6 illustrates various contours and shapes for the gas inlet port 501, gas distribution ports 601, channel 602, gas distribution channel 605, and gas distribution channel 606; however, it is contemplated that other shapes and contours can be used which collectively provide for flow of a gas through the piston rod 165 to the gas permeable ring 608 of the piston 160.

The high pressure of the externally pressurized gas is greater than the compression pressure in the cylinder 170 of the reciprocating compressor 100 in which the piston assembly 161 is contained. The pressure balances the force of the outward segment with the gas interface to provide a non-contacting frictionless gas lubricated operation of the piston 160.

Figure 7:
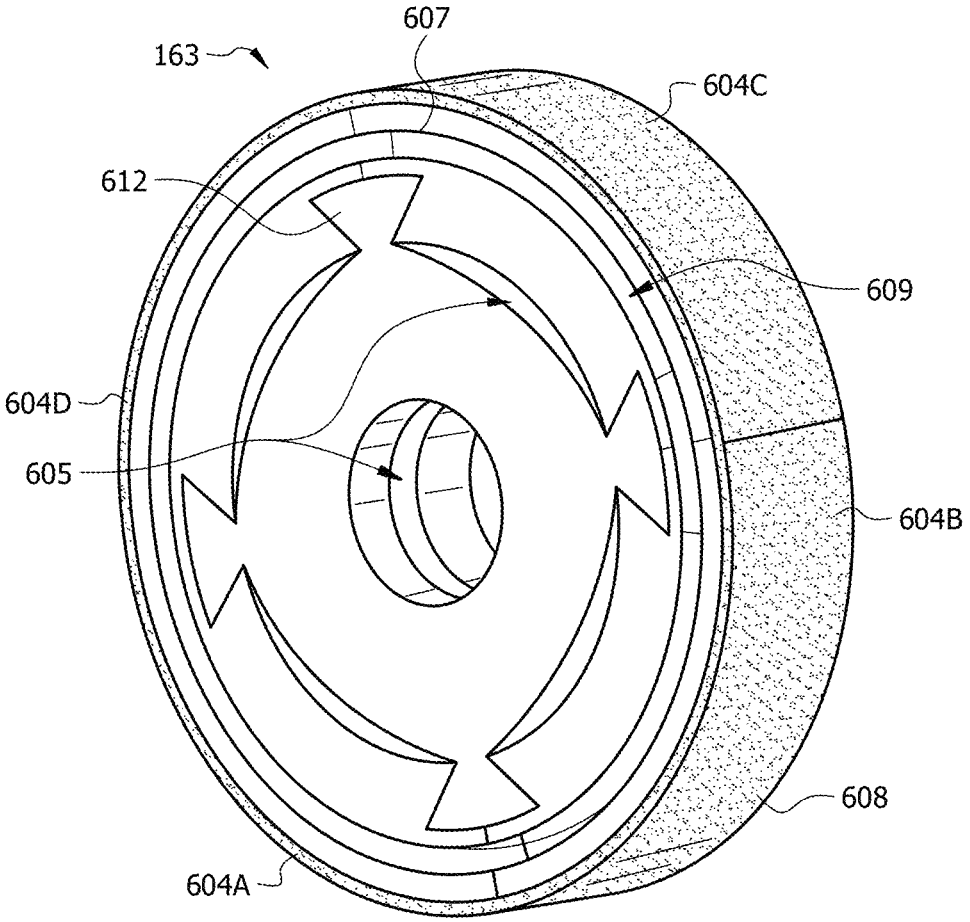
FIG. 7 illustrates a perspective view of a piston core.

FIG. 7 illustrates an isolated perspective view of a piston core 163, assembled. The piston core 163 has gas distribution core 603, piston segments 604A, 604B, 604C, 604D contacting the gas distribution core 603, the compression ring 609 placed in the compression ring groove 607, and the gas permeable ring 608 extending around the piston segments 604A, 604B, 604C, and 604D. The piston core 163 includes guide members 612 configured to guide and keep the piston segments 604A, 604B, 604C, and 604D in place. The gas distribution channel 605 can be seen on the interior of the gas distribution core 603. The gas distribution channel 605 faces and fluidly connects with the gas distribution ports 601 on the piston rod 165.

Additional Description

Various aspects of processes, reciprocating compressors, a piston rod packing unit, and a piston have been described. The following are non-limiting, specific aspects in accordance with the present disclosure:

Aspect 1. A process comprising: receiving, by a reciprocating compressor, a process gas having a process pressure; compressing, by the reciprocating compressor, the process gas to form a compressed gas having a compression pressure, wherein the compression pressure is greater than the process pressure; and injecting a secondary gas into a first ring of a plurality of packing rings of a piston rod packing unit of the reciprocating compressor at a first injection pressure that is greater than the compression pressure, wherein each of the plurality of packing rings is configured to surround an outer wall of a piston rod of the reciprocating compressor, wherein the first ring of the plurality of packing rings has a permeable flowpath, a channel, or both a permeable flowpath and a channel formed therein, wherein the secondary gas passes through the permeable flowpath, the channel, or both the permeable flowpath and the channel of the first ring, to form a first gas interface between the outer wall of the piston rod and the first ring of the plurality of packing rings.

Aspect 2. The process of Aspect 1, wherein the first gas interface lubricates the first ring of the plurality of packing rings during compressing.

Aspect 3. The process of Aspect 1 or 2, wherein the first gas interface provides a first gas seal that prevents the process gas, the compressed gas, or both the process gas and the compressed gas from leaking from a crank side of the piston rod packing unit.

Aspect 4. The process of any one of Aspects 1 to 3, wherein the first ring positioned next to a crank side of the piston rod packing unit.

Aspect 5. The process of any one of Aspects 1 to 4, further comprising: injecting a process compatible gas into a second ring of the plurality of packing rings of the piston rod packing unit of the reciprocating compressor at the first injection pressure or at a second injection pressure that is greater than the compression pressure.

Aspect 6. The process of Aspect 5, wherein the process compatible gas passes through the permeable flowpath, the channel, or both the permeable flowpath and the channel of the second ring of the plurality of packing rings, to form a second gas interface between the outer wall of the piston rod and the second ring of the plurality of packing rings.

Aspect 7. The process of Aspect 6, wherein the second gas interface lubricates the second ring of the plurality of packing rings during compressing.

Aspect 8. The process of Aspect 6 or 7, wherein the second gas interface provides a second gas seal that prevents the process gas, the compressed gas, or both the process gas and the compressed gas from leaking from a crank side of the piston rod packing unit.

Aspect 9. The process of any one of Aspects 5 to 8, further comprising: injecting the process compatible gas into a third ring of the plurality of packing rings of the piston rod packing unit of the reciprocating compressor at the first injection pressure or at the second injection pressure.

Aspect 10. The process of Aspect 9, wherein the process compatible gas passes through the permeable flowpath, the channel, or both the permeable flowpath and the channel of the third ring of the plurality of packing rings, to form a third gas interface between the outer wall of the piston rod and the second ring of the plurality of packing rings.

Aspect 11. The process of Aspect 10, wherein the third gas interface lubricates the third ring of the plurality of packing rings during compressing.

Aspect 12. The process of Aspect 10 or 11, wherein the third gas interface provides a third gas seal that prevents the process gas, the compressed gas, or both the process gas and the compressed gas from entering a piston side of the piston rod packing unit.

Aspect 13. The process of any one of Aspects 5 to 12, further comprising: flowing a portion of the process compatible gas into a channel formed in a piston rod of a piston of the reciprocating compressor; flowing the portion of the process compatible gas from the channel and into one or more gas distribution channels of a piston assembly of the piston; and forming a third gas interface between a cylinder of the reciprocating compressor and the piston assembly.

Aspect 14. The process of Aspect 13, wherein the third gas interface lubricates the cylinder during compressing.

Aspect 15. The process of any one of Aspects 5 to 14, further comprising: flowing the process compatible gas from a later-stage reciprocating compressor to the piston rod packing unit, wherein the first injection pressure or the second injection pressure of the process compatible gas is equal to a discharge pressure of the later-stage reciprocating compressor.

Aspect 16. The process of any one of Aspects 1 to 4, further comprising: flowing a portion of the secondary gas into a channel formed in a piston rod of a piston of the reciprocating compressor; flowing the portion of the secondary gas from the channel and into one or more gas distribution channels of a piston assembly of the piston; and forming a second gas interface between a cylinder of the reciprocating compressor and the piston assembly.

Aspect 17. The process of Aspect 16, wherein the second gas interface lubricates the cylinder during compressing.

Aspect 18. The process of any one of Aspects 1 to 17, wherein the secondary gas comprises nitrogen, argon, or a combination thereof.

Aspect 19. A reciprocating compressor comprising: a prime mover; a crank shaft coupled to the prime mover, wherein the prime mover is configured to turn the crank shaft; a connecting rod having an end coupled to the crank shaft; a crosshead coupled to an opposite end of the connecting rod; a piston comprising a piston assembly and a piston rod, the piston rod having an end coupled to the crosshead; a cylinder having an interior configured for a longitudinal movement of the piston assembly therein; a process gas inlet fluidly connected to the interior of the cylinder and a compressed gas outlet fluidly connected to the interior of the cylinder; and a piston rod packing unit.

Aspect 20. The reciprocating compressor of Aspect 19, the piston rod packing unit comprising: a rod packing case having a gas inlet port formed therein; a compression sleeve placed within the rod packing case, wherein an outer wall of the compression sleeve contacts an inner wall of the rod packing case; a plurality of packing rings placed within the compression sleeve, wherein each of the plurality of packing rings is configured to surround an outer wall of a piston rod, wherein each of the plurality of packing rings has a permeable flowpath, a channel, or both a permeable flowpath and a channel formed therein; wherein the gas inlet port fluidly connects with the channel of at least one of the plurality of packing rings.

Aspect 21. The reciprocating compressor of Aspect 19 or 20, wherein the piston rod packing unit is configured to utilize an externally pressurized secondary gas received via the gas inlet port to provide a gas seal between i) one or more of the plurality of packing rings and ii) the piston rod, wherein the gas seal prevents or reduces process gas and compressed gas in the interior of the cylinder from leaking from the piston rod packing unit into a hollow interior of a housing of the reciprocating compressor, while allowing a reciprocating movement of the piston rod in the piston rod packing unit.

Aspect 22. The reciprocating compressor of any of Aspects 19 to 21, wherein the piston rod of the piston has: a gas supply port formed in a first location of the piston rod that is configured to reciprocate within a piston rod packing unit; a gas outlet port formed in a second location of the piston rod; and a channel formed in an interior of the piston rod, wherein the channel is fluidly connected to the gas supply port and the gas outlet port; wherein the piston assembly includes: a piston core including one or more gas distribution channels in fluid communication with the gas outlet port of the piston rod; a plurality of piston segments, wherein each of the plurality of piston segments has a channel in fluid communication at least one of the one or more gas distribution channels of the piston core; and a gas permeable ring placed around the plurality of piston segments, wherein the gas permeable ring is fluidly connected to the channels of the plurality of piston segments.

Aspect 23. A piston rod packing unit for a reciprocating compressor, comprising: a rod packing case having a gas inlet port formed therein; a compression sleeve placed within the rod packing case, wherein an outer wall of the compression sleeve contacts an inner wall of the rod packing case; and a plurality of packing rings placed within the compression sleeve, wherein each of the plurality of packing rings is configured to surround an outer wall of a piston rod, wherein each of the plurality of packing rings has a channel formed therein; wherein the gas inlet port fluidly connects with the channel of at least one of the plurality of packing rings.

Aspect 24. The piston rod packing unit of Aspect 23, wherein the piston rod packing unit is configured to utilize an externally pressurized secondary gas received via the gas inlet port to provide a gas seal between i) one or more of the plurality of packing rings and ii) the piston rod, wherein the gas seal prevents or reduces process gas and compressed gas in an interior of a cylinder of the reciprocating compressor from leaking from the piston rod packing unit into a hollow interior of a housing of the reciprocating compressor, while allowing a reciprocating movement of the piston rod in the piston rod packing unit.

Aspect 25. A process comprising: receiving, by a reciprocating compressor, a process gas having a process pressure; compressing, by the reciprocating compressor, the process gas to form a compressed gas having a compression pressure, wherein the compression pressure is greater than the process pressure; and injecting a piston gas through a channel formed in a piston rod and into one or more distribution channels formed in a piston assembly at an injection pressure that is greater than the compression pressure; wherein the piston gas passes through the one or more distribution channels to form a gas interface between an outer surface of the piston assembly and an inner surface of a cylinder of the reciprocating compressor.

Aspect 26. The process of Aspect 25, wherein the piston gas comprises a secondary gas or a process compatible gas.

Aspect 27. The process of Aspect 25 or 26, further comprising: flowing a packing gas from a piston rod packing unit of the reciprocating compressor to a gas inlet port formed on the piston rod, wherein the gas inlet port is fluidly connected to the channel formed in the piston rod, wherein the piston gas comprises the packing gas.

Aspect 28. The process of Aspect 27, wherein the packing gas comprises a secondary gas or a process compatible gas.

Aspect 29. The process of any one of Aspects 25 to 28, further comprising: injecting the secondary gas into a first ring of a plurality of packing rings of the piston rod packing unit of the reciprocating compressor at an injection pressure that is greater than the compression pressure.

Aspect 30. The process of Aspect 29, wherein each of the plurality of packing rings is configured to surround an outer wall of a piston rod of the reciprocating compressor, wherein the first ring of the plurality of packing rings has a permeable flowpath, a channel, or both a permeable flowpath and a channel formed therein, wherein the secondary gas passes through the permeable flowpath, the channel, or both the permeable flowpath and the channel of the first ring, to form a first gas interface between the outer wall of the piston rod and the first ring of the plurality of packing rings.

Aspect 31. A piston for a reciprocating compressor, comprising: a piston rod having: a gas supply port formed in a first location of the piston rod that is configured to reciprocate within a piston rod packing unit; a gas outlet port formed in a second location of the piston rod; and a channel formed in an interior of the piston rod, wherein the channel is fluidly connected to the gas supply port and the gas outlet port; and a piston assembly connected to the piston rod, wherein the piston assembly comprises: a piston core comprising one or more gas distribution channels in fluid communication with the gas outlet port of the piston rod; a plurality of piston segments, wherein each of the plurality of piston segments has a channel in fluid communication at least one of the one or more gas distribution channels of the piston core; and a gas permeable ring placed around the plurality of piston segments, wherein the gas permeable ring is fluidly connected to the channels of the plurality of piston segments.

Although the present disclosure and its advantages have been described in detail, it should be understood that various changes, substitutions, and alterations can be made herein without departing from the spirit and scope of the disclosure as defined by the appended claims. Moreover, the scope of the present application is not intended to be limited to the particular embodiments of the process, machine, manufacture, composition of matter, means, method and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A process comprising:

permeating a piston gas through a porous media of a piston assembly of a piston of a reciprocating compressor and into a space between an inner surface of a cylinder of the reciprocating compressor and the porous media of the piston assembly, wherein the piston gas comprises a process compatible gas, a secondary gas, or both the process compatible gas and the secondary gas; and forming, with the piston gas, a gas interface in the space between the inner surface of the cylinder of the reciprocating compressor and the porous media of the piston assembly, wherein the gas interface lubricates the piston assembly and the cylinder, wherein the cylinder is not oil lubricated.

2. The process of claim 1, wherein the process compatible gas comprises a process gas or hydrogen.

3. The process of claim 1, wherein the secondary gas comprises nitrogen, argon, or a combination thereof.

4. The process of claim 1, further comprising:

receiving, by the reciprocating compressor, a process gas having a process pressure; and compressing, by the reciprocating compressor, the process gas to form a compressed gas having a compression pressure, wherein the compression pressure is greater than the process pressure.

5. The process of claim 4, wherein a pressure of the piston gas is equal to or greater than the compression pressure.

6. The process of claim 4, further comprising:

injecting the piston gas into the piston assembly at an injection pressure that is greater than the compression pressure.

7. The process of claim 1, wherein the gas interface forms a gas seal that prevents a compressed gas from flowing through the space.

8. The process of claim 1, further comprising:

flowing the piston gas into one or more gas distribution channel of the piston assembly; and flowing the piston gas from the one or more gas distribution channel to the porous media.

9. The process of claim 1, further comprising:

flowing the piston gas into a rod channel formed in a piston rod of the piston of the reciprocating compressor;

flowing the piston gas from the rod channel into one or more gas distribution channel of the piston assembly; and flowing the piston gas from the one or more gas distribution channel to the porous media.

10. A reciprocating compressor comprising:

a prime mover;

a crank shaft coupled to the prime mover, wherein the prime mover is configured to turn the crank shaft;

a connecting rod having an end coupled to the crank shaft;

a crosshead coupled to an opposite end of the connecting rod;

a piston comprising a piston assembly and a piston rod, the piston rod having an end coupled to the crosshead, wherein the piston assembly comprises a porous media;

a cylinder having an interior configured for a longitudinal movement of the piston assembly therein; and a piston rod packing unit, wherein the piston rod extends through the piston rod packing unit;

wherein a piston gas permeates through the porous media of the piston assembly into a space between the porous media of the piston assembly and an inner surface of the cylinder to form a gas interface between the porous media of the piston assembly and the inner surface of the cylinder, wherein the gas interface lubricates the piston assembly and the cylinder during a reciprocating movement of the piston assembly in the cylinder, wherein the cylinder is not oil lubricated.

11. The reciprocating compressor of claim 10, wherein the piston assembly comprises:

one or more piston core comprising the porous media, wherein the porous media defines an outer surface of the piston core that faces an inner surface of the cylinder.

12. The reciprocating compressor of claim 11, wherein each piston core further comprises one or more gas distribution channel inside the piston core and in fluid communication with the porous media of the piston core.

13. The reciprocating compressor of claim 11, wherein each piston core further comprises a gas distribution core and a plurality of segments surrounding the gas distribution core.

14. The reciprocating compressor of claim 13, wherein the gas distribution core comprises a first gas distribution channel, wherein each of the plurality of segments comprises a second gas distribution channel, wherein the second gas distribution channel of each of the plurality of segments is in fluid communication with the first gas distribution channel of the gas distribution core and with the porous media.

15. The reciprocating compressor of claim 11, wherein the piston assembly further comprises:

a crank end; and a head end, wherein each of the one or more piston core is positioned between the crank end and the head end of the piston assembly.

16. The reciprocating compressor of claim 10, wherein the piston rod comprises a channel formed therein, wherein the channel is in fluid communication with the porous media of the piston assembly.

* * * * *